US006431795B2

(12) United States Patent
White

(10) Patent No.: US 6,431,795 B2
(45) Date of Patent: Aug. 13, 2002

(54) SYSTEMS AND METHODS FOR INSERTING WICK DRAIN MATERIAL

(75) Inventor: John L. White, Kent, WA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 09/754,648

(22) Filed: Jan. 3, 2001

Related U.S. Application Data

(63) Continuation-in-part of application No. 09/415,042, filed on Oct. 7, 1999, now abandoned, which is a continuation-in-part of application No. 08/900,481, filed on Jul. 25, 1997, now Pat. No. 6,039,508.

(60) Provisional application No. 60/122,151, filed on Feb. 26, 1999.

(51) Int. Cl.[7] ..... E02D 7/00; E02D 7/26

(52) U.S. Cl. ..... 405/232; 405/50; 254/95; 175/55; 175/56

(58) Field of Search ..... 405/50, 198, 232; 254/95, 97; 175/19, 55, 56, 162; 166/71, 77.1

(56) References Cited

U.S. PATENT DOCUMENTS

| | | | |
|---|---|---|---|
| 628,962 | A | 7/1899 | Speer |
| 1,288,989 | A | 12/1918 | Rees |
| 1,322,470 | A | 11/1919 | Schenk |

(List continued on next page.)

FOREIGN PATENT DOCUMENTS

| | | | |
|---|---|---|---|
| EP | 0172960 | A1 | 3/1986 |
| EP | 0526743 | B1 | 8/1995 |
| FR | 838717 | | 3/1939 |
| FR | 2560247 | | 2/1984 |

(List continued on next page.)

OTHER PUBLICATIONS

A series of photographs identified by reference Nos. APE01147 through APE01159. (Undated).

Japanese language brochure entitled "Castle Board Drain Method", 1978.

"The 1st Report on the Treatment of Soft Foundation in Juck Hyun Industrial Site" (Ref. Nos. APE00854 through APE00856). (Undated).

(List continued on next page.)

*Primary Examiner*—H. Shackelford
*Assistant Examiner*—Jong-Suk Lee
(74) *Attorney, Agent, or Firm*—Michael R. Schacht; Schacht Law Office, Inc.

(57) ABSTRACT

A system for displacing an elongate member relative to the ground. The system includes a drive rack, a support assembly, a vibratory assembly, and a drive assembly. The vibratory assembly comprises a vibratory housing defining a vibratory chamber and a vibratory axis and a vibratory system mounted within the vibratory chamber to generate a vibratory force along the vibratory axis. The drive assembly comprises a drive housing comprising a main portion defining a drive chamber and, in certain configurations, a sleeve portion defining a sleeve chamber, where a drive axis extends through the drive chamber and the sleeve chamber and a drive system mounted within the drive chamber and comprising a drive gear that rotates to generate a drive force along the drive axis. The vibratory housing is mounted onto the support assembly to reduce the transmission of vibratory forces from the vibratory housing to the support assembly. The drive housing is attached to the vibratory assembly such that the drive axis, the vibratory axis, and a longitudinal axis of the elongate member are substantially aligned and, if used, the sleeve portion extends through at least a substantial portion of the vibratory chamber. The elongate member extends through the drive chamber and the sleeve chamber such that the drive gear engages the drive rack to transfer at least one of the vibratory force and the drive force to the elongate member and thereby displace the elongate member relative to the ground.

22 Claims, 11 Drawing Sheets

U.S. PATENT DOCUMENTS

| | | | | | |
|---|---|---|---|---|---|
| 1,654,093 | A | | 12/1927 | Reid | |
| 1,903,555 | A | | 4/1933 | Robertson | |
| 2,577,252 | A | | 12/1951 | Kjellman | |
| 2,952,132 | A | | 9/1960 | Urban | |
| 3,172,485 | A | | 3/1965 | Spannhake et al. | |
| 3,300,987 | A | | 1/1967 | Maeda | |
| 3,313,376 | A | | 4/1967 | Holland, Sr. | |
| 3,381,422 | A | | 5/1968 | Olson | |
| 3,391,435 | A | | 7/1968 | Lebelle | |
| 3,684,037 | A | | 8/1972 | Bodine | |
| 3,711,161 | A | | 1/1973 | Proctor et al. | |
| 3,871,617 | A | | 3/1975 | Majima | |
| 3,874,244 | A | | 4/1975 | Rasmussen et al. | |
| 3,891,186 | A | | 6/1975 | Thorsell | |
| 3,907,042 | A | | 9/1975 | Halwas et al. | |
| 4,082,361 | A | | 4/1978 | Lanfermann | |
| 4,155,600 | A | | 5/1979 | Lanfermann et al. | |
| 4,166,508 | A | | 9/1979 | van den Berg | |
| 4,195,698 | A | | 4/1980 | Nakagawasai | |
| 4,428,699 | A | | 1/1984 | Juhola | |
| 4,455,105 | A | | 6/1984 | Juhola | |
| 4,537,527 | A | | 8/1985 | Juhola et al. | |
| 4,553,443 | A | | 11/1985 | Rossfelder et al. | |
| 4,601,615 | A | | 7/1986 | Cavalli | |
| 4,627,768 | A | | 12/1986 | Thomas et al. | |
| 4,735,270 | A | | 4/1988 | Fenyvesi | |
| 4,755,080 | A | | 7/1988 | Cortlever et al. | |
| 4,813,814 | A | | 3/1989 | Shibuta et al. | |
| 4,863,312 | A | | 9/1989 | Cavalli | |
| 5,004,055 | A | * | 4/1991 | Porritt et al. | 175/55 X |
| 5,117,925 | A | | 6/1992 | White | |
| 5,213,449 | A | | 5/1993 | Morris | |
| 5,263,544 | A | | 11/1993 | White | |
| 5,281,775 | A | | 1/1994 | Gremillion | |
| 5,355,964 | A | | 10/1994 | White | |
| 5,439,326 | A | | 8/1995 | Goughnour et al. | |
| 5,544,979 | A | | 8/1996 | White | |
| 5,609,380 | A | | 3/1997 | White | |
| 5,658,091 | A | | 8/1997 | Goughnour et al. | |
| 5,860,482 | A | * | 1/1999 | Gremillion et al. | 175/19 |
| 6,039,508 | A | | 3/2000 | White | |
| 6,179,527 | B1 | * | 1/2001 | Goughnour | 405/232 |
| 6,234,260 | B1 | * | 5/2001 | Coast et al. | 175/19 X |
| 6,250,426 | B1 | * | 6/2001 | Lombard | 182/146 |

FOREIGN PATENT DOCUMENTS

| | | | | |
|---|---|---|---|---|
| GB | 2003769 | A | 8/1978 | |
| GB | 2023496 | A | 1/1980 | |
| GB | 2043755 | * | 10/1980 | 405/232 |
| GB | 2060742 | * | 5/1981 | 405/232 |
| GB | 2028902 | B | 8/1982 | |
| KR | 16944/1992 | | 9/1992 | |
| NL | 42349 | | 1/1938 | |
| NL | 65252 | | 2/1950 | |
| NL | 7710385 | | 9/1977 | |
| NL | 7707303 | | 1/1979 | |
| NL | 7805153 | | 11/1979 | |
| SU | 1027357 | A | 7/1983 | |
| WO | WO87/07673 | | 12/1987 | |
| WO | WO88/05843 | | 8/1988 | |

OTHER PUBLICATIONS

Schematic drawings identified by Ref. Nos. APE01038, APE01039, and APE0339. (Undated).

A report identifying systems for driving mandrels carrying wick drain material into the earth, identified by Ref. Nos. APE0510 through APE0536. (Undated).

Korean language document identified by reference No. APE00864 through APE00891. (Undated).

* cited by examiner

SYSTEMS AND METHODS FOR INSERTING WICK DRAIN MATERIAL

RELATED APPLICATIONS

This application is a continuation-in-part of U.S. patent application Ser. No. 09/415,042 which was filed on Oct. 7, 1999, abandoned, which is a continuation-in-part of U.S. patent application Ser. No. 08/900,481, which was filed on Jul. 25, 1997, U.S. Pat. No. 6,039,508 and also claims priority of U.S. Provisional Application No. 60/122,151, which was filed on Feb. 26, 1999.

TECHNICAL FIELD

The present invention relates to methods and apparatus for inserting into the earth and extracting from the earth elongate members and, more particularly, to apparatus and methods for inserting wick drain material into the earth.

BACKGROUND OF THE INVENTION

For certain construction projects, elongate members such as piles, anchor members, caissons, and mandrels for inserting wick drain material must be placed into and in some cases withdrawn from the earth. It is well-known that, in many cases, such rigid members may be driven into and withdrawn from the earth without prior excavation.

The present invention is particularly advantageous when employed to insert a mandrel carrying wick drain material into the earth, and that application will be described in detail herein. However, the present invention may have broader application to the insertion into and removal from the ground of other elongate members such as piles, anchor members, and caissons, especially when these members must be driven at an angle with respect to horizontal. Accordingly, the scope of the present invention should be determined by the scope of the claims appended hereto and not the following detailed description.

Because wick drain material is flexible, it cannot be directly driven into the earth. Instead, it is normally placed within a rigid mandrel that is driven into the earth. Once the mandrel and wick drain material have been driven into the earth, the mandrel alone is removed from the earth, leaving the wick drain material in place. The wick drain material that is left in place wicks moisture in its vicinity to the surface to stabilize the ground at that point.

Conventionally, two types of systems are employed to drive mandrels into and remove mandrels from the earth. A first system is referred to as a top drive system and engages the upper end of the mandrel to insert the mandrel into the earth. In a top drive system, the upper end of the mandrel is securely attached to the drive system and forced downward or upward to insert the mandrel into or remove the mandrel from the ground. The upper end of the mandrel may also be vibrated by a vibratory drive means and/or crowded by a chain or cable drive means to cause the mandrel to penetrate the earth.

The primary disadvantage with the top drive system is that they require a substantial boom structure to support the mandrel and associated drive means. The requirement of a large and heavy boom structure limits the length of the mandrel that may be driven by a top drive system. Further, as the ground into which the wick drain material is to be inserted may be wet and unstable, the ground may not be sufficiently stable to support the required boom structure. Top drive systems thus may be inappropriate in certain situations.

The conventional second system for inserting and removing mandrels engages the bottom end of the mandrel and will be referred to herein as a bottom drive system. A bottom drive system is not attached to any one point on the mandrel; instead, rotating roller surfaces and/or gear teeth engage the mandrel in a manner that displaces the mandrel along its axis to drive it into the ground.

Bottom drive systems require a boom sufficient to support only the mandrel; the boom for a bottom drive system may thus be significantly lighter than that for a top drive system, which alleviates some of the problems associated with large booms.

However, the primary disadvantage with known bottom drive systems is that they rely entirely on the roller or gear drive system for insertion and removal of the mandrel. Bottom drive system do not have the benefit of a vibratory device for situations in which the mandrel becomes stuck due to soil conditions. In addition to conventional top drive systems and bottom drive systems, the Applicant of the present invention has developed a variation on the bottom drive systems that integrates a bottom gear drive with a vibratory device. The Applicant's device will be referred to herein as the vibratory bottom drive device and is described in U.S. Pat. No. 6,039,508.

In the vibratory bottom drive device, the mandrel extends through the vibratory device such that the vibratory loads are applied substantially along the longitudinal axis of the mandrel. The vibratory forces are applied to the mandrel through a gear drive system that allows the mandrel to be driven by the crowding forces generated by the gear device and/or the vibratory forces generated by the vibratory device.

In practice, the vibratory bottom drive device works well. However, the need generally exists for a more flexible vibratory bottom drive system having components arranged to minimize wear and increase reliability.

RELATED ART

U.S. Pat. No. 5,213,449 to Morris shows, and USSR Patent No. SU 1027357 appears to show, bottom drive devices for driving a mandrel into the ground. The Morris patent discloses a gear dive system and the USSR patent appears to show a roller drive system.

Top drive wick drain inserters are disclosed in U.S. Pat. No. 3,891,186 to Thorsell, U.S. Pat. No. 4,166,508 to van den Berg, U.S. Pat. No. 4,755,080 to Cortlever et al., Dutch Pat. No. 65252, Dutch Pat. No. 7805153, and Dutch Pat. No. 7,707,303.

The Thorsell patent employs a chain attached to the top of a wick drain mandrel to crowd the mandrel into the ground.

The van den Berg patent employs a two-part mandrel, with the two parts being wound around rollers and crowded into the ground by unwinding the rollers.

The Cortlever et al. patent discloses a cable connected to the upper end of the mandrel and a hydraulic system for displacing the cable to drive or crowd the mandrel into the ground.

The Dutch '252 and '153 patents appear to employ a chain to drive or crowd a mandrel into the ground.

In the Dutch '703 patent, a vibratory device appears to be fixed to the top end of the mandrel to drive the mandrel into the ground.

Shown in U.S. Pat. Nos. 5,117,544 and 5,117,925 issued to the Applicant are vibratory devices for driving piles into the earth. These patents disclose placing the vibratory device on top of the pile to be driven and vibrating the pile along its axis; the combination of the vibratory forces along the axis of the pile and the weight of the pile and vibratory device drives the pile into the ground. Caissons may be driven into the ground in the same manner.

SUMMARY OF THE INVENTION

The present invention is a system for inserting and removing elongate members. The system includes a drive rack, a support assembly, a vibratory assembly, a drive assembly, and a shock absorbing member. The drive rack is formed on at least one surface of the elongate member. The support assembly supports the elongate member at a desired location on the ground.

The vibratory assembly comprises a vibratory housing defining a vibratory chamber and a vibratory axis and a vibratory system mounted within the vibratory chamber to generate a vibratory force along the vibratory axis.

The drive assembly comprises a drive housing comprising a main portion defining a drive chamber and, in certain configurations, a sleeve portion defining a sleeve chamber, where a drive axis extends through the drive chamber and the sleeve chamber and a drive system mounted within the drive chamber and comprising a drive gear that rotates to generate a drive force along the drive axis.

The shock absorbing member mounts the vibratory housing onto the support assembly to reduce the transmission of vibratory forces from the vibratory housing to the support assembly. The drive housing is attached to the vibratory assembly such that the drive axis, the vibratory axis, and a longitudinal axis of the elongate member are substantially aligned and the sleeve portion extends through at least a substantial portion of the vibratory chamber. The elongate member extends through the drive chamber and the sleeve chamber such that the drive gear engages the drive rack to transfer at least one of the vibratory force and the drive force to the elongate member and thereby displace the elongate member relative to the ground.

DETAILED DESCRIPTION OF THE INVENTION

1. First Embodiment

Figure 1:
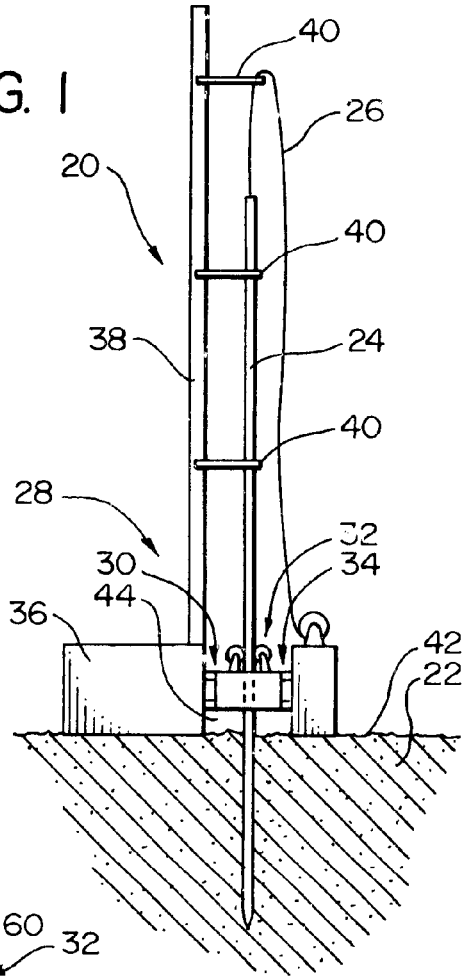
FIG. 1 is a side plan view of a first elongate member insertion/removal system that is constructed in accordance with the principles of the present invention.

Turning now to the drawing, depicted at 20 in FIG. 1 is an elongate member insertion/withdrawal system constructed in accordance with, and embodying, the principles of the present invention. The system 20 is designed to insert into and remove from the ground 22 a mandrel 24 carrying wick drain material 26, but other elongate members may be driven by the system 20 in a similar manner.

The exemplary system 20 comprises a support assembly 28, a vibratory assembly 30, a gear drive assembly 32, and a shock absorbing assembly 34. The support assembly 28 comprises a support base 36, a mast 38, and mandrel support 40. The support base 36 is designed to engage a surface 42 of the ground 22 and provide a solid, stable surface for supporting the mast 38. The support base 36 can be a self-propelled platform such as a tracked vehicle or may, as shown, be placed directly onto the ground surface 42.

The mast 38 vertically extends from the support base 36, and the mandrel supports 40 horizontally extend from vertically spaced locations on the mast 38. The mandrel 24 is encircled by the mandrel supports 40 before and during insertion of the mandrel 24 into the ground 22. The support assembly 28 thus maintains the mandrel 24 in a desired orientation with respect to the ground; in the exemplary system 20, this desired orientation is vertical.

The vibratory assembly 30 is located in a channel 44 extending from top to bottom through the support base 36. The shock absorbing assembly 34 mounts the vibratory assembly 30 within the channel 44 in a manner that: (a)

maintains the vibratory assembly 30 in a desired location relative to the ground 22; and (b) absorbs vibratory forces generated by the vibratory assembly 30 and thus reduces the transmission of these forces to the support means. The vibratory assembly 30 is thus free to vibrate up and down within the channel 44, and only acceptably low levels of vibration are transmitted to the support base 36.

Figure 2:
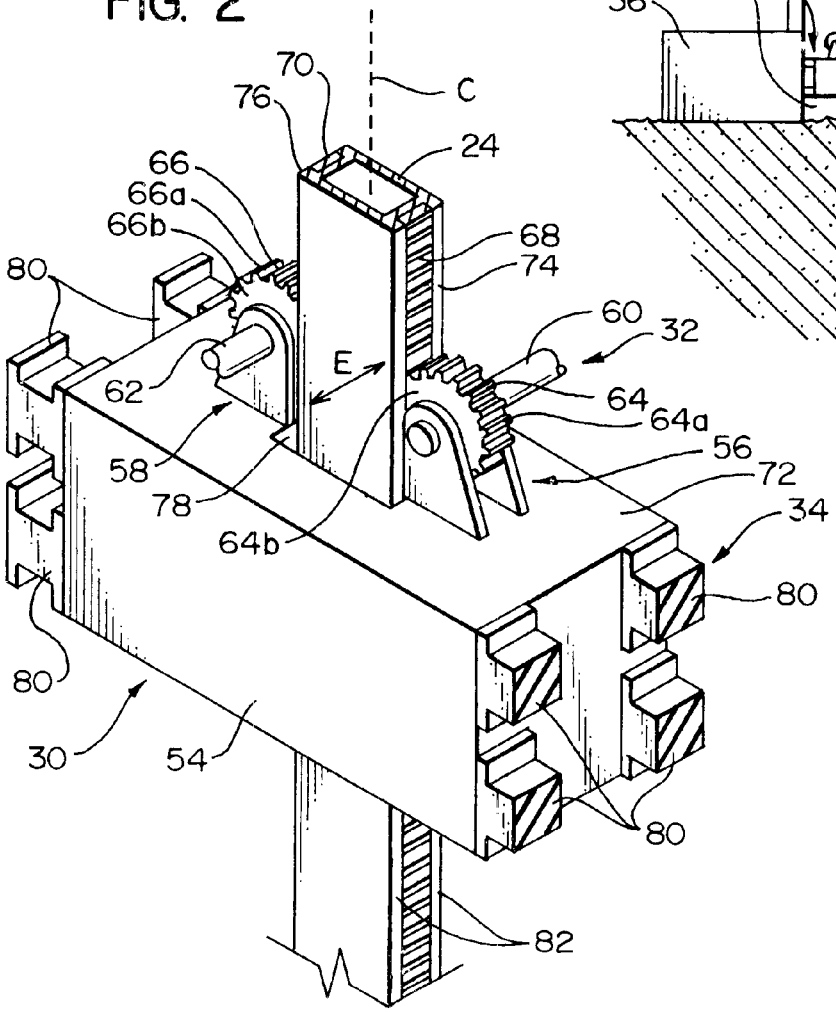
FIG. 2 is a perspective view of the vibratory assembly, gear drive assembly, and shock absorbing assembly of the system depicted in FIG. 1.
Figure 3:
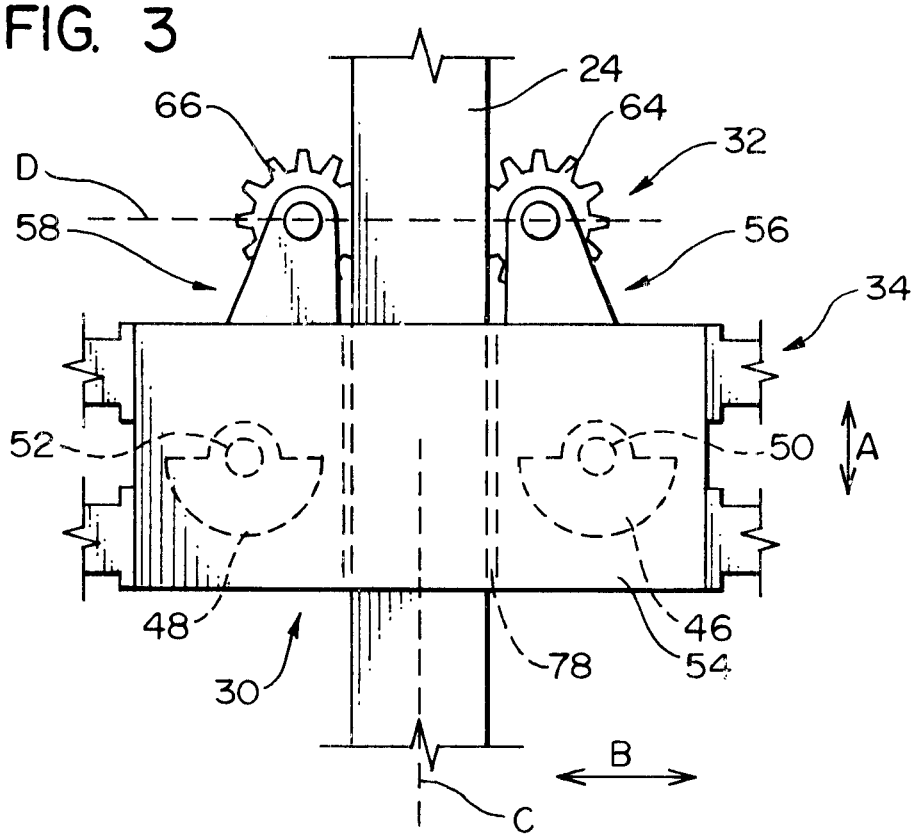
FIG. 3 is a side plan view of the assemblies depicted in FIG. 2.

Referring now to FIGS. 2 and 3, depicted in more detail therein are the mandrel 24, the vibratory assembly 30, the gear drive assembly 32, and the shock absorbing assembly 34.

Referring initially to the vibratory assembly 30, FIG. 3 shows a conventional vibratory assembly comprises first and second eccentric weight members 46 and 48 fixed onto vibratory shafts 50 and 52 mounted within a housing 54. The vibratory shafts 50 and 52 are horizontal and parallel to each other.

To cause the housing 54 to vibrate, the vibratory shafts 50 and 52 are rotated by motors (not shown) at the same speed in opposite directions, which causes the eccentric members 46 and 48 to rotate about the axes of these shafts 50 and 52. The eccentric members 46 and 48 are mounted on the vibratory shafts 50 and 52 such that: (a) the lateral forces on the housing 54 (in the direction of arrow B in FIG. 3) generated by the eccentric members 46 and 48 substantially cancel each other; while (b) the vertical forces on the housing 54 (in the direction of arrow A in FIG. 3) generated by the eccentric members 46 and 48 are added to each other and transmitted to the housing 54. The result is that this rotation of the eccentric members 46 and 48 causes the housing 54 to vibrate with great force along a vibratory axis in the vertical direction and very little in the lateral direction.

The gear drive assembly 32 is perhaps best shown in FIG. 2. The gear drive assembly 32 basically comprises first and second bracket assemblies 56 and 58, first and second drive shafts 60 and 62, and first and second drive gears 64 and 66, and first and second drive racks 68 and 70. The bracket assemblies 56 and 58 are securely attached to an upper surface 72 of the vibratory housing 54. The drive shafts 60 and 62 are mounted on the bracket assemblies 56 and 58, respectively, above the housing surface 72 such that the shafts 60 and 62 can be rotated about their axes. The drive gears 64 and 66 are mounted on the drive shafts 60 and 62 such that the gears 64 and 66 are securely held at a fixed distance above the housing surface 72.

The first and second drive racks 68 and 70 are formed on opposite surfaces 74 and 76 of the mandrel 24. The mandrel 24 extends through a vertical mandrel passageway 78 formed in the housing 54 such that the racks 68 and 70 engage teeth 64*a* and 66*a* of the drive gears 64 and 66.

Accordingly, rotation of the drive shafts 60 and 62 in the opposite direction by a motor (not shown) causes the drive gears 64 and 66 to rotate, which in turn causes the gear teeth 64*a* and 66*a* to engage the drive racks 68 and 70 to displace the mandrel 24 along its lengthwise axis C (FIG. 2). In this fashion, the mandrel 24 can be moved either up or down along its axis C relative to the vibratory housing 54.

At this point, it should be noted that the unshown motors employed to turn the vibratory shafts 50 and 52 and the drive shafts 60 and 62 are preferably direct fluid to torque hydraulic motors. The motors should be able to withstand severe vibration because they must be mounted on the vibratory housing 54, and direct fluid to torque motors are much less susceptible to vibration damage than hydraulic motors employing a planetary gear. Appropriate direct fluid to torque hydraulic motors are available from, for example, POCLAIN under the model name CAM TRACK. The source of the pressurized fluid employed to drive these motors is preferably mounted on the support base 36 and connected to the hydraulic motors via flexible hoses. This arrangement of hydraulic motors and fluid source minimizes: (a) the amount of equipment that is directly subjected to the vibratory forces generated by the vibratory assembly 30; and (b) the damage to the equipment that is subjected to these vibratory forces.

Referring now to FIGS. 2 and 3, these Figures show that the shock absorbing assembly 34 comprises eight rectangular solid shock absorbing members 80 (only seven shown in FIG. 2) that are flanged such that they can be bolted to the vibratory housing 54 and the support base 36. These members 80 are made of strong, resilient, rubber-like material. When the vibratory housing 54 vibrates up and down, these shock absorbing members 80 allow the housing to move up and down a short distance relative to the support base 36; in doing so, the members 80 yieldingly resist the transmission of vibratory forces from the vibratory housing 54 to the support base 36. Accordingly, the shock absorbing assembly 34 effectively isolates the support base from the vibratory forces generated by the vibratory assembly 54.

In operation, the mandrel 24 will initially be arranged with a lower end 24*a* thereof adjacent to the surface 42 of the ground 22 and with the wick drain material 26 loaded therein. The drive shafts 60 and 62 will then be rotated to cause the mandrel 24 to enter the ground 22. The downward force applied by the gear drive assembly 32 may in many cases be sufficient to drive the mandrel 24 to the desired depth.

However, in some cases, the soil conditions of the ground 22 may be such that the force applied by the gear drive assembly 32 is insufficient and the mandrel 24 can not be inserted into or withdrawn from the ground 22. In these cases, the vibratory shafts 50 and 52 may be rotated to cause the vibratory housing 54 to vibrate up and down. These vibratory forces will be transmitted to the mandrel 24 at the points where the teeth 64*a* and 66*a* of the drive gears 64 and 66 engage the drive racks 68 and 70. The mandrel 24 will thus be vibrated up and down along its axis C. Such vibration is extremely effective at overcoming resistance to the insertion and withdrawal of the mandrel 24.

Further, the vibratory forces generated by the vibratory assembly 30 may be applied at the same time as the drive forces generated by the gear drive assembly 32; the gear drive assembly 32 is mounted on the vibratory housing 54 and will move up and down at the same rate as the vibratory housing 54. The combination of a driving force and a vibratory force can greatly increase the speed at which the mandrel 24 is inserted into and withdrawn from the ground 22.

The elongate member insertion/withdrawal system 20 thus exhibits all of the benefits of a bottom drive system as described above but in addition allows the use of vibratory forces when soil conditions require such forces and simply to speed up the process of inserting or removing wick drain mandrels.

Several features of the insertion/withdrawal system 20, while not essential to the operation of the present invention, are believed to optimize the implementation of the present invention and will now be discussed in further detail.

For example, FIGS. 2 and 3 both show that the vibratory assembly 30 is substantially symmetrically arranged about the axis C of the mandrel 24. More particularly, as shown in FIG. 3 the eccentric members 46 and 48 and shafts 50 and 52 connected thereto are arranged the same distance from the mandrel axis C, with the shafts 50 and 52 orthogonal to this axis C. With this arrangement, the vibratory forces are applied along the mandrel axis C. Without such symmetry, the vibratory forces would cause a torsional load to be exerted on the mandrel 24. Such a torsional load would increase the stress on the mandrel 24 and/or the gear drive assembly 32 that engages the mandrel 24 and thus the likelihood of damage thereto.

Another optional feature of the present invention is the location of the drive gears 64 and 66 relative to the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus reduces stresses thereon. The placement of the gears 64 and 66 also mean that the vertical vibratory forces transmitted to the mandrel 24 are applied in a symmetrical fashion that alleviates twisting of the mandrel 24. The lateral forces applied on the mandrel 24 by these gears 64 and 66 are in opposite directions along a line D shown in FIG. 3. With this arrangement, it is not necessary to pinch the mandrel 24 at two points in order to displace it along its axis; instead, the gears 64 and 66 need only apply sufficient lateral loads to maintain the mandrel 24 at the center of the passageway 78. This eliminates the need to place a constant load on the mandrel 24 and thus undue stresses thereon. The placement of the gears 64 and 66 also means that the vertical vibratory forces transmitted to the mandrel 24 are applied in a symmetrical fashion that alleviates twisting of the mandrel 24.

Another noteworthy but non-essential feature of the present invention is that the drive racks 68 and 70 are recessed into the mandrel surfaces 74 and 76. This creates ridges 82 extending along the length of the racks 68 and 70 that engage the sides 64*b* and 66*b* of the drive gears 64 and 66 to prevent the mandrel 24 from moving in either direction along an arrow E in FIG. 2; this direction shown by arrow E is orthogonal to the mandrel axis C and to the line D shown in FIG. 3.

2. Second Embodiment

Figure 4:
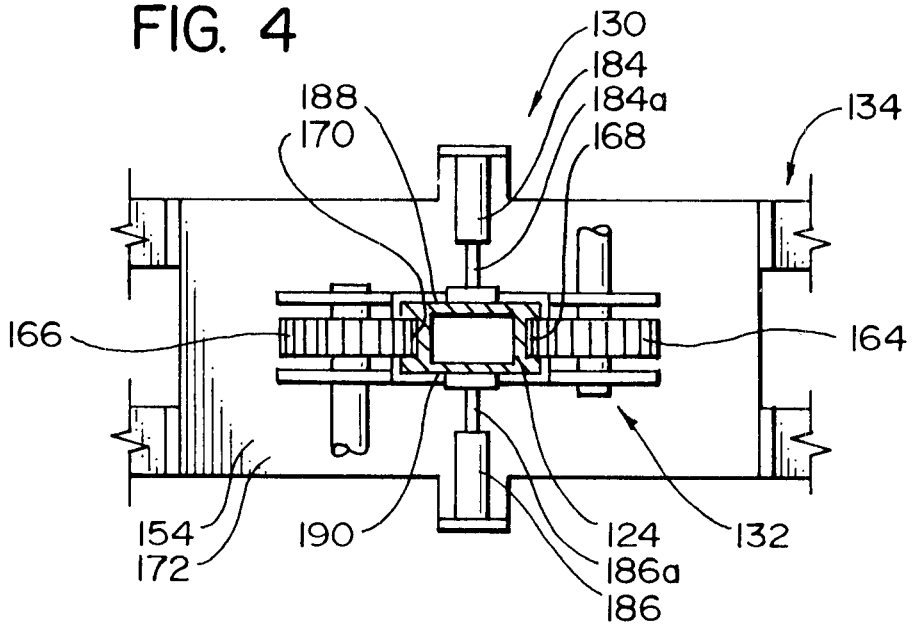
FIG. 4 is a top plan view of a portion of a second exemplary elongate member insertion/removal system that is constructed in accordance with the principles of the present invention.

A second exemplary elongate member insertion/withdrawal system will now be described with reference to FIG. 4. In FIG. 4, components that are the same as those described above with reference to FIGS. 1–3 will be given the same reference character plus one hundred. Such like components will not be described again in detail below.

FIG. 4 shows that securely secured to the upper surface 172 of the vibratory housing 154 are first and second hydraulic piston assemblies 184 and 186. These assemblies 184 and 186 are arranged on opposite sides of the mandrel 124. Pistons 184*a* and 186*a* are extendable from the assemblies 184 and 186, respectively, to engage opposite surfaces 188 and 190 of the mandrel 124.

Thus, by appropriate application of hydraulic fluid to the piston assemblies 184 and 186, the pistons 184*a* and 186*a* of these assemblies can engage the mandrel 124 to fix the position of the mandrel 124 relative to the vibratory housing 154. This allows the vibratory forces generated by the vibratory assembly 130 to be transmitted to the mandrel 124 primarily through the piston assemblies 184 and 186 and only to a lesser extent through the gear drive assembly 132. The piston assemblies 184 and 186 can thus alleviate wear on the drive gears 164 and 166 and the drive racks 168 and 170 in situations where the mandrel 124 is only being vibrated and not driven along its axis.

Figure 5:
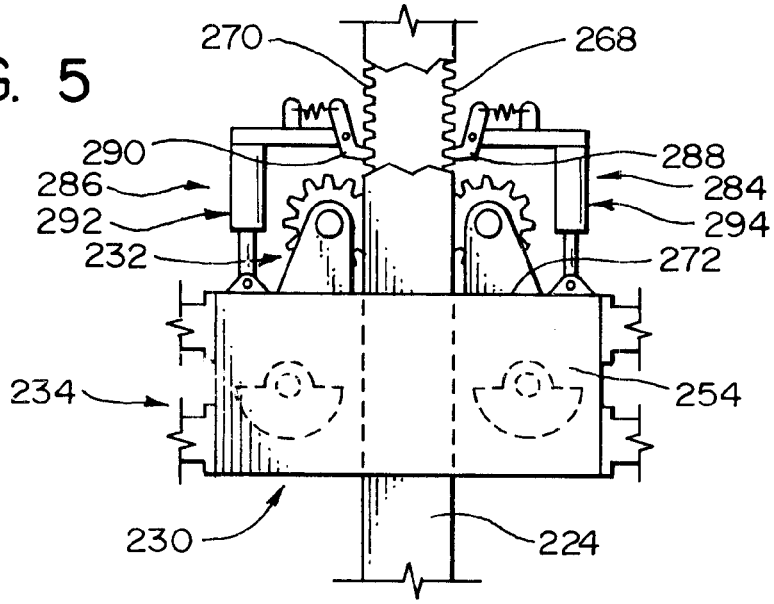
FIG. 5 is a side plan view of a portion of a third exemplary elongate member insertion/removal system that is constructed in accordance with the principles of the present invention.

A third exemplary elongate member insertion/withdrawal system will now be described with reference to FIG. 5. In FIG. 5, components that are the same as those described above with reference to FIGS. 1–3 will be given the same reference character plus two hundred. Such like components will not be described again in detail below.

FIG. 5 shows that securely mounted onto the upper surface 272 of the vibratory housing 254 of this third exemplary system are first and second hydraulic drive assemblies 284 and 286. These hydraulic drive assemblies 284 and 286 are arranged to apply vertical forces on the mandrel 224.

In particular, during normal operation engaging members 288 and 290 of these assemblies 284 and 286 are disengaged from the racks 268 and 270 and the mandrel 224 is driven by the gear drive assembly 232. However, when the forces generated by the gear drive assembly 232 are not sufficient to insert or withdraw the mandrel 224, the engaging members 288 and 290 engage the mandrel 224 through the racks 268 and 270.

Drive piston assemblies 292 and 294 of the hydraulic drive assemblies 284 and 286 are then operated to act on the mandrel 224 through the members 288 and 290 and force the mandrel 224 in either direction along its axis. The forces of the hydraulic drive assemblies 284 and 286 may be sufficient to insert or withdraw the mandrel 224 in cases where the forces generated by the gear drive assembly 232 are not. Further, the hydraulic drive assemblies 284 and 286 will be particularly effective when used in conjunction with vibratory forces generated by the vibratory assembly 230.

3. Third Embodiment

Figure 6:
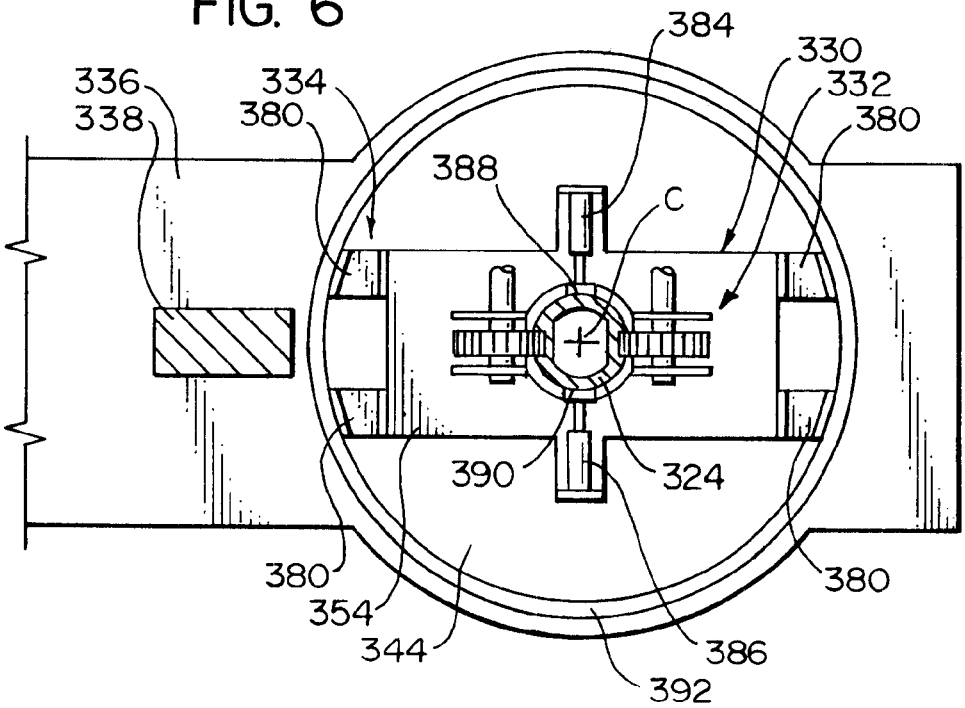
FIG. 6 is a top plan view of a portion of a third exemplary elongate member insertion/removal system that is constructed in accordance with the principles of the present invention.

A third exemplary elongate member insertion/withdrawal system will now be described with reference to FIG. 6. In FIG. 6, components that are essentially the same as those described above with reference to FIGS. 1–4 and will be given the same reference character plus three hundred. Such like components will be described below only to the extent that they differ from the corresponding components described above.

As shown in FIG. 6, in this third exemplary system the channel 344 in the support base 336 is cylindrical. Further, the shock absorbing means 380 of the shock absorbing assembly 334 are connected between the vibratory housing 354 and an intermediate ring 392 mounted onto the support base 336 within the channel 344. The intermediate ring 392 is rotatable about the mandrel axis C relative to the support base 336. Further, the mandrel 334 itself is rounded.

In use, the intermediate ring 392, and thus the vibratory assembly 330, gear drive assembly 332, and mandrel 324, may be rotated about the mandrel axis C. In certain situations rotation of the mandrel 324 may be needed to overcome soil conditions and drive the mandrel 324 into or remove the mandrel 324 from the ground 22. The rounded configuration of the mandrel 324 facilitates the rotation of the mandrel 324 about its axis.

4. Fourth Embodiment

Referring now to FIGS. 7–10, depicted at 420 therein is yet another wick drain inserting system constructed in accordance with, and embodying, the principles of the present invention.

The exemplary system 420 comprises an insertion assembly 422 that is pivotably connected to an arm 424 by a pin 426. The arm 424 is connected to an excavator, crane, or spotter (not shown) such that the insertion assembly 422 may be moved from place to place. An actuator assembly 428 is connected between the insertion assembly 422 and the arm 424. The effective length of the actuator assembly 428 may be increased or decreased; operating the actuator assembly 428 thus rotates the insertion assembly 422 about the longitudinal axis of the pin 426, thereby allowing an angle between the insertion assembly 422 and the arm 424 to be changed. Systems other than the arm 424, such as those described in the previous and subsequent embodiments, may be used to support the insertion assembly 422.

During use, the actuator assembly 428 allows the insertion assembly 422 to be arranged in a proper orientation with respect to the ground. During transportation and storage, the effective length of the actuator member 428 may be decreased so that the insertion assembly 422 is folded back substantially parallel to the arm 424.

The exemplary insertion assembly 422 comprises a mast or boom assembly 430, a housing assembly 432, a mandrel assembly 434, a linear drive assembly 436, a vibration assembly 438, a suppression assembly 440 (FIG. 9), and a feed subsystem 442.

Figure 7:
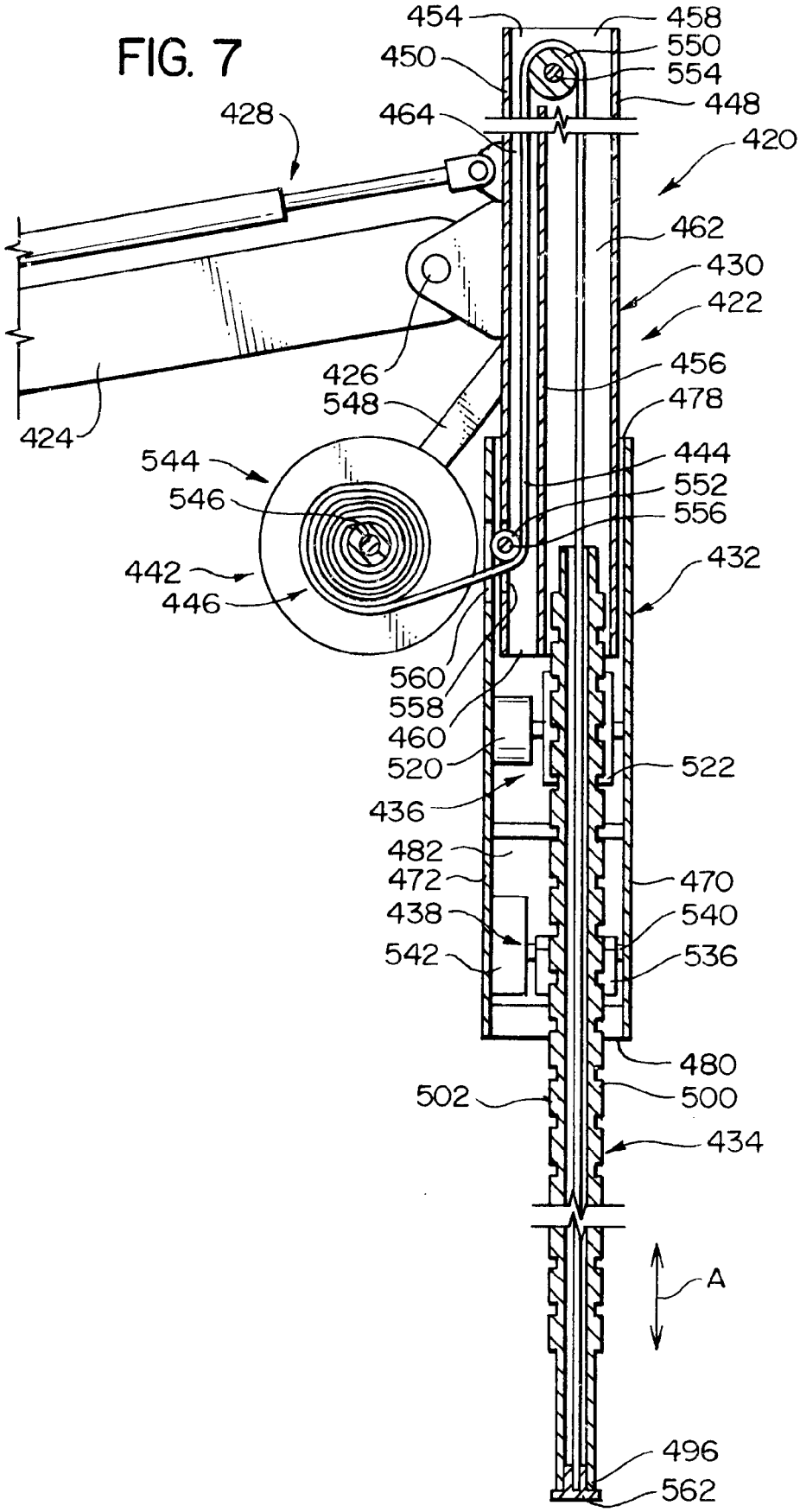
FIG. 7 is a vertical section view of an insertion assembly constructed in accordance with, and embodying, the principles of the present invention.

The linear drive assembly 436 is arranged to displace the mandrel assembly 434 along its axis relative to the housing assembly 432 (in the direction shown by arrow A in FIG. 7). The linear drive assembly 436 also transfers loads on the housing assembly 432 to the mandrel assembly relative.

The vibration assembly 438 may be operated to cause the housing assembly 436 to vibrate in the direction shown by arrow A. Vibratory forces on the housing assembly 436 are transferred to the mandrel assembly 434 by the mandrel drive assembly 436.

The suppression assembly 440 connects the mast assembly 430 to the housing assembly 432 such that the housing assembly 432 may move within a limited range relative to the mast assembly 430. The purpose of the suppression assembly 440 is to inhibit the transfer of the vibratory loads from the housing assembly 440 to the mast assembly 430.

The feed subsystem 442 is configured to feed wick drain material 444 from a roll 446 into the mandrel assembly 434.

The insertion system 420 operates basically as follows. The arm 424 is moved and actuator assembly 428 operated until the insertion assembly 422 is vertically arranged above a desired location at which the wick drain material 444 is to be inserted into the earth. The linear drive assembly 436 is operated to crowd the mandrel assembly 434 into the earth at the desired location. In many situations, excessive resistance will not be encountered, and the linear drive assembly 436 alone will drive the mandrel assembly 434 to its desired depth.

Should the system 420 encounter excessive resistance using the linear drive assembly 436 alone, the vibration assembly 438 may be operated. In most cases, excessive resistance can be overcome by the combination of crowding using the linear drive system 436 and the vibratory loads generated by the vibration assembly 438. Accordingly, both the linear drive assembly 436 and the vibration assembly 438 will be used together whenever excessive resistance is encountered.

Once the excessive resistance is overcome, the vibration assembly 438 will be turned off; in general, vibration is hard on equipment and thus should be used only when necessary.

After the mandrel assembly 434 has been driven to its desired depth, the linear drive assembly 436 will be reversed to withdraw the mandrel assembly 434 from the ground.

With the foregoing general explanation in mind, the construction and operation of the system 420 will now be described in further detail.

Figure 9:
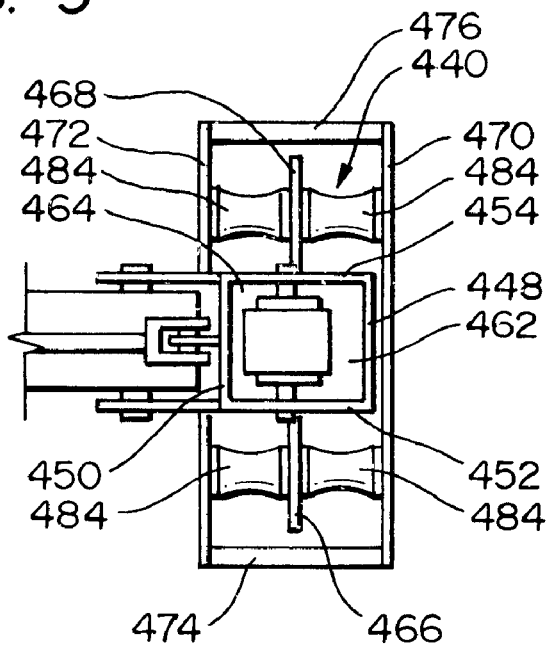
FIG. 9 is a top plan view of the insertion assembly of FIG. 7 with background details omitted for clarity.

As perhaps best shown in FIGS. 7 and 9, the mast assembly 430 comprises a front wall 448, a back wall 450, a first side wall 452, a second side wall 454, and an interior wall 456 (FIG. 7). The walls 448–54 are joined together to form an elongate box such that the mast assembly has an open upper end 458 and an open lower end 460. The interior wall 456 divides the interior of the mast assembly 430 into a forward compartment 462 and a rear compartment 464. The mast assembly 430 further comprises first and second side flanges 466 and 468 that rigidly extend from the first and second side walls 452 and 454 adjacent to the mast lower end 460.

Figure 8:
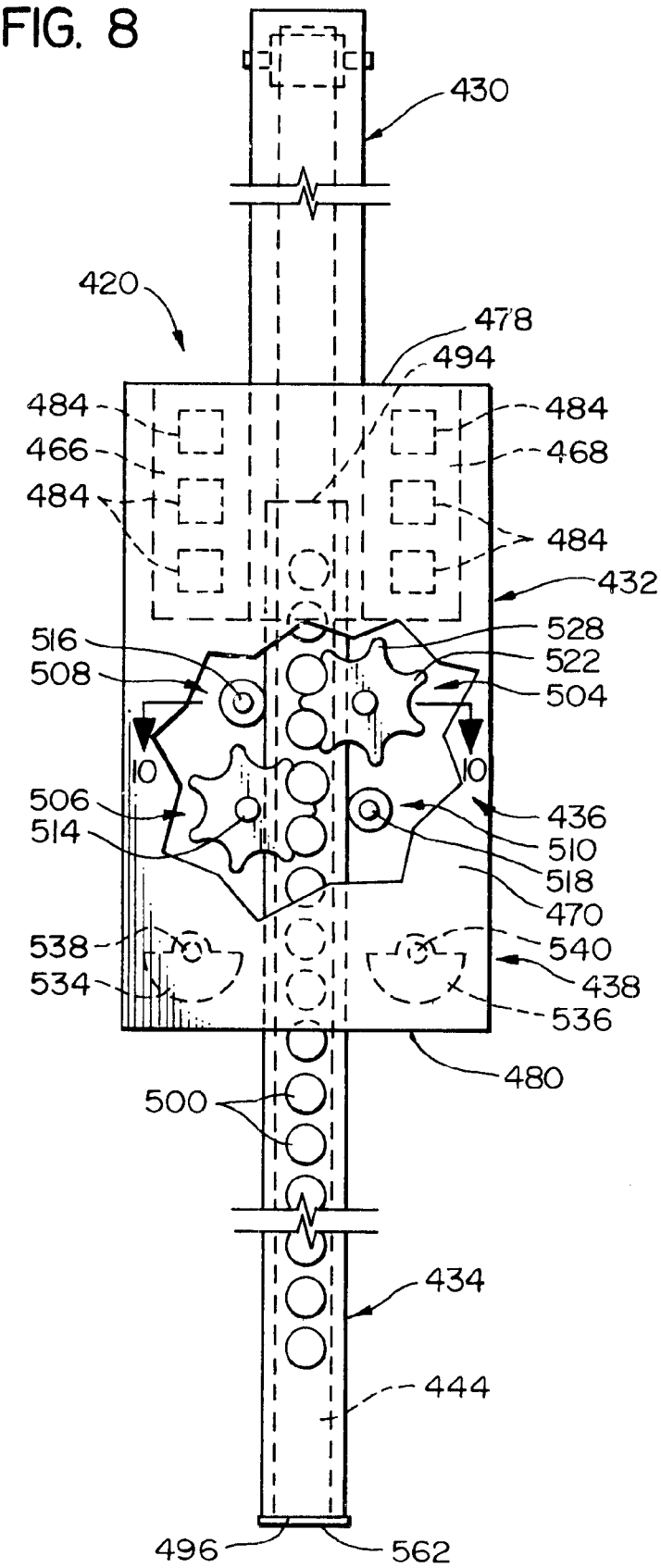
FIG. 8 is a front plan view of the insertion assembly of FIG. 7.

FIGS. 7, 8, and 9 illustrate that the housing assembly 432 comprises a front wall 470, back wall 472, first side wall 474, and second side wall 476. These walls 470–76 are joined together to form a box such that the housing assembly 432 has an open upper end 478 and open lower end 480 and defines a housing chamber 482.

The mast assembly 430 extends through the housing upper end 478 and partially into the housing chamber 482. In particular, as perhaps best shown in FIGS. 8 and 9, the mast flanges 466 and 468 and portions of the mast walls 448–54 adjacent to these flanges 466 and 468 normally reside completely within the housing chamber 482.

The exemplary suppression assembly 440 comprises twelve elastomeric members 484. As shown in FIG. 8, six of these member 484 are connected between front surfaces of the mast flanges 466 and 468 and the rear surface of the housing front wall 470. Six of these members are also connected between rear surfaces of the mast flanges 466 and 468 and the front surface of the housing rear wall 472.

The elastomeric members 484 allow, but resiliently oppose, a small degree of relative movement between the mast assembly 430 and the housing assembly 432. These members 484 thus transfer loads between the mast assembly 430 and the housing assembly 432 but absorb shocks that would otherwise be transmitted between these assemblies. More specifically, these elastomeric members 484 prevent transmission of most vibratory loads and shocks from excessive ground resistance from the housing assembly 432 to the mast assembly 430. This protects the mast assembly 432 and arm 424 from these shocks.

Figure 10:
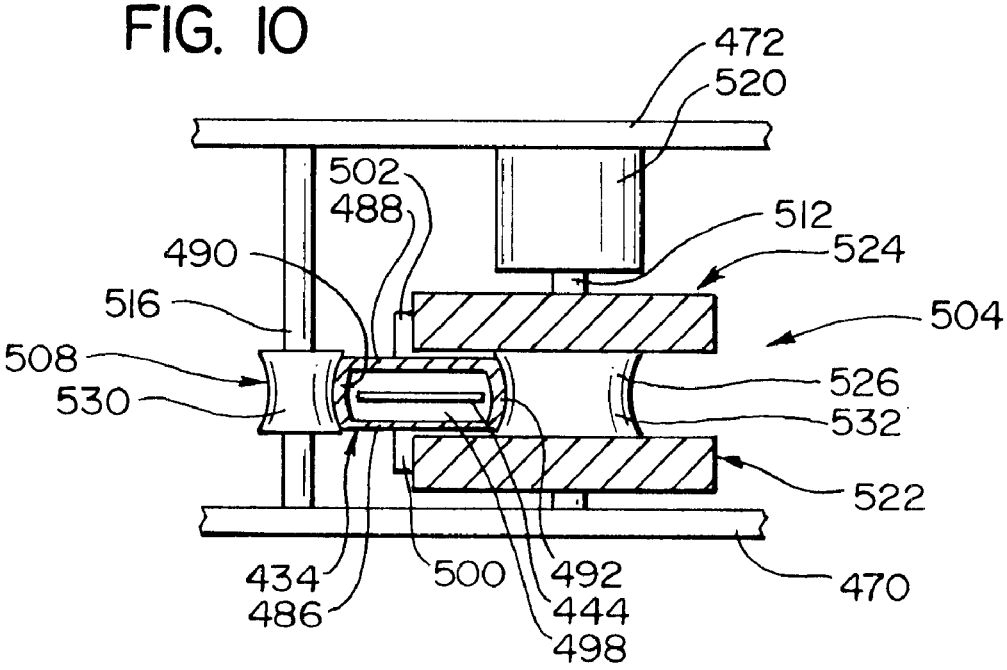
FIG. 10 is a top section view taken along lines 10—10 in FIG. 8, again with background details omitted for clarity.

Referring now to FIG. 10, it can be seen that the mandrel assembly 434 comprises a front wall 486, back wall 488, first side wall 490, and second side wall 492. These walls 486–92 are joined together in an elongate box such that the mandrel assembly has an open upper end 494 and an open lower end 496 and defines a mandrel chamber 498. The front and back walls 486 and 488 are flat, while the side walls 490 and 492 are outwardly curved.

Extending from the front wall 486 is a first row of pins 500, and extend from the back wall 488 is a second row of pins 502. These pins 500 and 502 extend approximately one-half an inch from and are evenly spaced along the length of the mandrel front and back walls 486 and 488. In the preferred embodiment, these pins are short hollow tubes secured by welding to the mandrel walls 486 and 488.

The mandrel assembly 434 is sized and dimensioned such that it may be received within the mast forward compartment 462.

The linear drive system 436 is shown in FIGS. 7, 8, and 10. This system 436 comprises first and second gear assemblies 504 and 506 and first and second roller assemblies 508 and 510. The gear assemblies 504 and 506 are mounted on shafts 512 and 514, and the roller assemblies 508 and 510 are mounted on shafts 516 and 518. The gear assemblies 504 and 506 are or may be almost identical to each other; similarly, the roller assemblies 508 and 510 are or may be almost identical to each other. Accordingly, only the gear assembly 504 and roller assembly 508 will be described in detail herein.

As shown in FIG. 10, the shafts 512 and 516 are connected to inner surfaces of the housing front wall 470 and housing rear wall 472. The gear shaft 512 is axially rotated by a hydraulic motor 520. The motor 520 is conventional and will not be discussed herein in detail.

The gear assembly 508 comprises first and second gear members 522 and 524 and a center portion 526. The gear members 522 and 524 comprise a series of teeth 528 radially extending from the shaft 512. The shafts 512 and 516 are configured such that the center portion 526 opposes the roller assembly 508.

The gear center portion 526 engages the mandrel second side wall 492 and the roller assembly 508 engages the mandrel first side wall 490. The center portion 526 and roller assembly 508 are arranged to prevent significant lateral motion of the mandrel assembly 434 relative to the housing assembly 432.

As shown in FIG. 10, the mandrel assembly 434 extends between the gear assembly 504 and the roller assembly 508. In particular, the gear assembly 504 straddles the mandrel assembly 434 such that the gear members 522 and 524 extend over a portion of the mandrel front and back walls 486 and 488, respectively. The teeth 528 extend between the pins 500 and 502 such that movement of the teeth 528 is transferred to the mandrel assembly 434.

Accordingly, when the motor 520 axially rotates the shaft 512, the gear members 522 and 524 rotate about the axis of the shaft 512; the gear teeth 528 engage the mandrel pins 500 and 502 such that, as the gear members 522 and 524 rotate, the mandrel assembly 434 is driven along its longitudinal axis. In particular, with reference to FIG. 8, clockwise rotation of the gear assembly 504 will result in upward movement of the mandrel assembly 434, while counterclockwise rotation of the gear assembly 504 will result in downward movement of the mandrel assembly 434.

In addition, the teeth 528 engage the pins 500 and 502 and the gear center portion 526 and roller assembly 508 engage the mandrel side walls 490 and 492 such that loads on the housing assembly 432 are transferred to the mandrel assembly 434, and vice versa.

In particular, the teeth 528 are contoured such that each tooth extending between two pins is in contact with the pin above and pin below. This transfers vertical loads between the housing assembly 432 and mandrel assembly 434 and reduces play in the system when the direction in which the mandrel assembly 434 is driven needs to be changed. The roller assembly 508 and gear center portion 526 have concave outer surfaces 530 and 532 that match the convex side walls 490 and 492 of the mandrel assembly 434. And the gear members 522 and 524 are closely arranged adjacent to the mandrel front and back walls 486 and 488. This configuration ensures that front-back, side, and vertical loads are all transferred between the housing and mandrel assemblies 432 and 434 without substantial movement between these assemblies.

As shown in FIG. 8, the vibration assembly 438 comprises a pair of eccentric weights 534 and 536 mounted on shafts 538 and 540 extending between the front and back housing walls 470 and 472. A conventional hydraulic motor 542 rotates the weights 534 and 536 in synchrony in opposite directions to develop a vertical vibratory force that is applied to the housing assembly 432 through the shafts 538 and 540.

As described above, vertical loads on the housing assembly 432 are applied to the mandrel assembly 434 by the gear assemblies 504 and 506 and roller assemblies 508 and 510. Thus, the vibratory forces generated by the vibration assembly 438 are transmitted to the mandrel assembly 434.

Referring again to FIG. 7, it can be seen that the feed subsystem 442 comprises a reel assembly 544 mounted on a shaft 546 extending between to reel struts 548 (only one shown in FIG. 7). The roll 446 of wick drain material 448 is placed onto the reel assembly 544.

The feed subsystem 442 further comprises upper and lower feed rollers 550 and 552 mounted on the mast assembly 430 adjacent to the mast upper and lower ends 458 and 460, respectively. As shown in FIG. 9, the upper feed roller is mounted on a shaft 554 extending between the mast side walls 452 and 454 above an upper edge surface of the internal wall 456. The lower roller 552 is mounted on a shaft 556 extending between the side walls 452 and 454 within a mast feed hole 558 formed in the mast back wall 450. A housing feed hole 560 is formed in the housing back wall 472 adjacent to the mast feed hole 558.

The wick drain material 444 is fed from the roll 446, through the housing feed hole 560 and mast feed hole 558, under the lower feed roller 552, through the rear mast compartment 464, over the upper feed roller 550, through the forward mast compartment 462, through the mandrel chamber 498, and to the mandrel lower end 496. At the mandrel lower end 496, the wick material 444 is attached to a wick drain shoe 562.

With the foregoing more detailed understanding of the construction of the system 420, the use of this system 420 will now be described in further detail.

A first operator will be sitting in an excavator or crane from which the arm 424 extends. A second operator will be on foot.

The first operator can look down the arm 424 towards the housing back wall 472. The excavator or crane is basically conventional, so the first operator may control the position of the insertion assembly 422 by operating the excavator or crane and the hydraulic assembly 428. The first operator thus arranges the insertion assembly 422 such that the mandrel lower end is located above the desired location where the wick drain material is to be inserted and the mast is at the appropriate angle with respect to vertical.

One of the operators operates the linear drive assembly 436 to rotate the gear assemblies 504 and 506, thereby crowding the mandrel assembly 434 into the earth. Because the wick drain material 444 is attached to the shoe 562, as the mandrel assembly 434 is crowded into the earth, the wick drain material 44 is taken off of the roll 446 by the feed subsystem 442 and placed into the earth with the mandrel assembly 434.

Should the mandrel assembly 434 encounter excessive ground resistance, the operators will notice the housing assembly 432 begin to move up relative to the boom assembly 430 by stretching the resilient members 484. At this point, the operator can operate the vibration assembly 438; this will cause the housing assembly 432 to move up and down at a rate related to the rotational speed of the weights 434. This up and down movement will be transferred to the mandrel assembly 434, which will help to overcome the excessive resistance and allow the mandrel assembly 434 to be crowded through the obstruction in the soil. The vibration assembly 438 is then turned off until another obstruction is encountered.

After the mandrel assembly 434 has been driven to its desired depth, the direction of the linear drive system 436 is reversed to withdraw the mandrel assembly 434 from the earth. Because the shoe 562 is not attached to mandrel assembly 434, the shoe 562 remains at the desired depth; and because the wick drain material 444 is attached to the shoe 562, the wick drain material remains in the hole formed by the mandrel assembly 434.

When the mandrel assembly 434 is completely withdrawn from the ground, the second operator will cut the wick drain material 444 above the ground and attach a new shoe 562 thereto. The system 420 is then moved to place the insertion assembly 422 at a new desired location, and the process described above is repeated.

The present invention provides a number of advantages over prior art methods.

By keeping the drive and vibration assemblies close to the ground, the mast need not be heavy. This allows potentially taller masts, as the mast only needs to bear the weight of the wick drain material; the linear drive assembly will support the mandrel. The mast assembly may even be constructed with a metal lower portion that is connected to the excavator arm and housing assembly and a plastic upper portion for supporting the wick drain material. With a light mast, the entire system can be made small and transportable, even to the extent that it can be mounted on a conventional excavator or crane with a large vertical mast. And this lightweight mast can be rotated downward for easy transportation and storage.

By driving the mandrel through the center of the vibration assembly, the vibrational loads are symmetrically applied to the mandrel. Such symmetrical loads reduce wear and tear on the mandrel and decrease the chance that the mandrel will fail during vibration.

The mandrel itself has a very small footprint. This is important as it reduces the amount that the mandrel compacts the soil as it is being driven into the earth. Compaction is a problem because it can interfere with flow of water to the wick drain for wicking to the surface.

The arrangement of two gear assemblies each having two gear members helps to balance the loads while the mandrel is being crowded into the ground. This arrangement also helps ensure that the vibratory loads applied to the mandrel are balanced. The placement of one gear assembly above the other allows the gear teeth to extend over half way between the mandrel pins, thus ensuring a secure transfer of downward motion to the mandrel. The vertically staggered gear teeth also force dirt out from between adjacent mandrel pins, removing dirt that might interfere with the insertion or removal of the mandrel.

This system of the present invention can also be easily manufactured from conventionally available parts.

5. Fifth Embodiment

Figure 11:
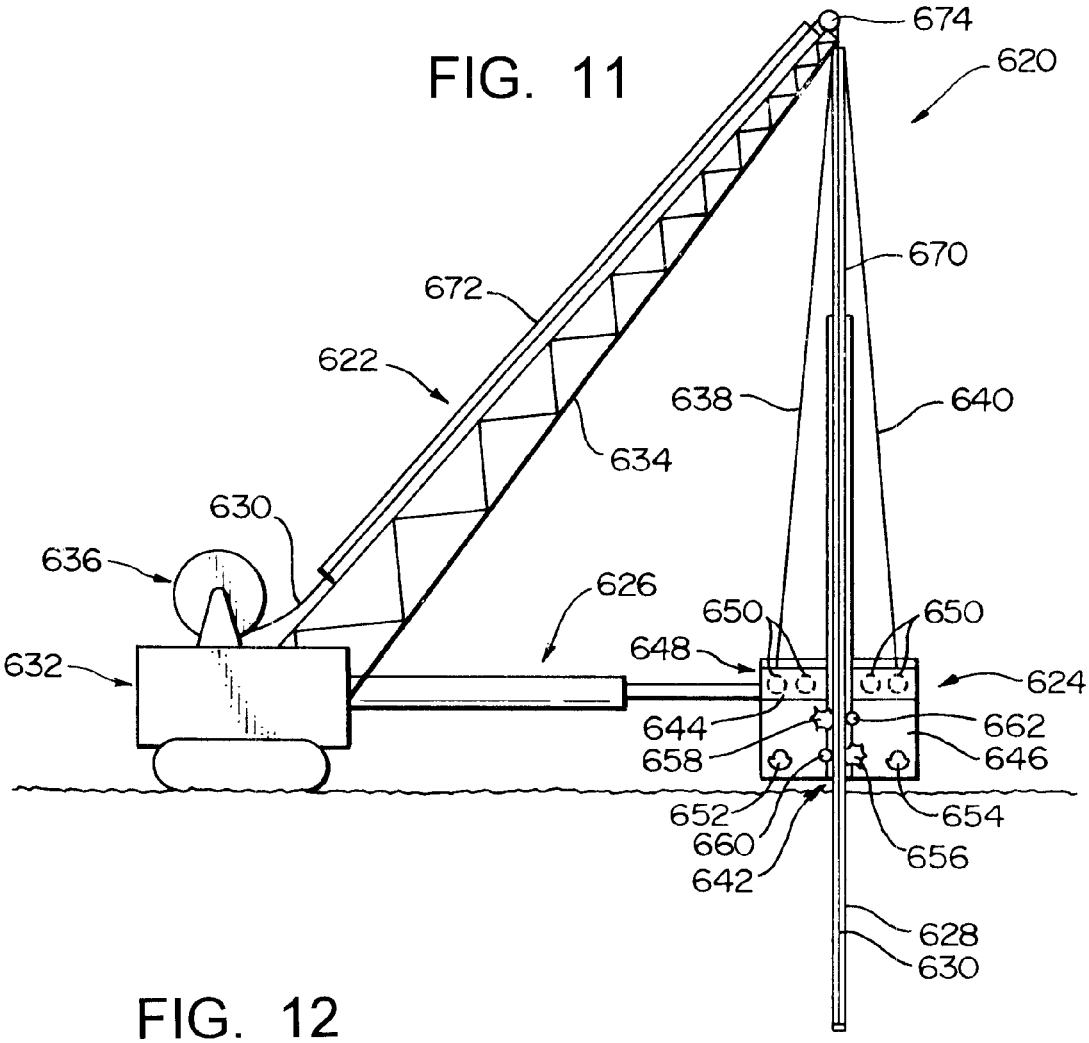
FIG. 11 is a somewhat schematic side elevation view of yet another exemplary elongate member insertion/removal system that is constructed in accordance with the principles of the present invention.

Referring now to FIG. 11 depicted therein at 620 is a wick driving system constructed in accordance with, and embodying, the principles of the present invention. This system 620 comprises a crane 622, an insertion assembly 624, a spotter 626, a mandrel 628, and wick drain material 630.

The crane 622 is generally conventional in that it has a cab portion 632 and a boom portion 634. Mounted on the conventional crane 622 is a roll 636 of the wick drain material 630.

Attached to the upper end of the boom 634 are first and second cables 638 and 640. These cables suspend the insertion assembly 624 above a location 642 at which the wick drain material 630 is to be inserted into the earth.

The insertion assembly 624 is schematically depicted in FIG. 11. Additionally, one side of the insertion assembly 624 is not shown so that the operation of the insertion assembly 624 may more easily be described.

In particular, the insertion assembly 624 comprises a fixed plate 644 to which the cable 638 and 640 are connected. This fixed plate 644 is connected to a housing 646 by a suppression system 648 comprising a plurality of elastomer blocks 650. The blocks 650 allow the housing 646 to move relative to the plate 644.

Mounted within the housing 646 are vibratory members 652 and 654 that are eccentric and rotate at the same speed in opposite directions such that lateral forces are cancelled and an up and down vibratory force is created. These vibratory devices 652 and 654 are well known in the art and will not be described in detail herein.

Further mounted to the housing 646 are drive gears 656 and 658. Opposing these drive gears 656 and 658 are rollers 660 and 662.

The mandrel 628 extends through the housing 646 between the vibratory devices 652 and 654, drive gear 656 and roller 660, and drive gear 658 and roller 662. The insertion assembly 624 is symmetrically arranged about the mandrel 628 such that the vibratory loads created by the vibratory devices 652 and 654 are applied symmetrically through the drive gears 656 and 658 and rollers 660 and 662 directly along a longitudinal axis of the mandrel 628.

The drive gears 656 and 658 are rotated to crowd the mandrel 628 into the earth or, in the opposite direction, to remove the mandrel 628 from the earth. When resistance is encountered, the vibratory devices 652 and 654 may be operated to impart vibratory loads to the mandrel 628; these loads assist the insertion/withdrawal of the mandrel 628. The vibration suppression system 648 inhibits transmission of vibratory loads from the housing 646 to the fixed plate 644.

As described above, the upper end of the crane boom 634 is connected by the cable 638 and 640 to the fixed plate 644. These cables 638 and 640, and thus the boom 634, are thus also at least partly isolated from the vibratory loads generated by the insertion assembly 624.

Optionally, as shown in FIG. 11, a spotter assembly 626 may be connected between the fixed plate 644 and the crane base 632. The spotter assembly 626 is conventional and allows the insertion assembly 624 to be moved relative to the crane base 632. Again, the spotter assembly 626 is connected to the fixed plate 644 and thus is as least partly isolated from the vibratory loads generated by the insertion assembly 624.

The insertion assembly 624 may thus be positioned above the desired location 642 by the crane 622 alone. The spotter assembly 626 will help with precise placement of the insertion assembly 624 and will help to prevent raising of the assertion assembly 624 when the mandrel 628 encounters difficulties while being inserted.

FIG. 11 also shows that the system 620 may optionally comprise a wind sleeve 670 and a boom sleeve 672. The wind sleeve 670 is attached at its upper end to the uppermost portion of the boom 634. The lower end of the wind sleeve 670 extends into the mandrel 628. The wind sleeve 670 thus prevents the wind from acting on the portion of the wick drain material 630 that extends between the top the boom 634 and the top of the mandrel 628.

The boom sleeve 672 is attached to the boom 634 and provides a channel through which the wick drain material 630 passes from the roll 636 up to the top of the boom 634. A roller 674 may optionally be provided at the top of the boom 634 to help feed the wick drain material 630 from the boom tube 672 into the wind tube 670.

Figure 12:
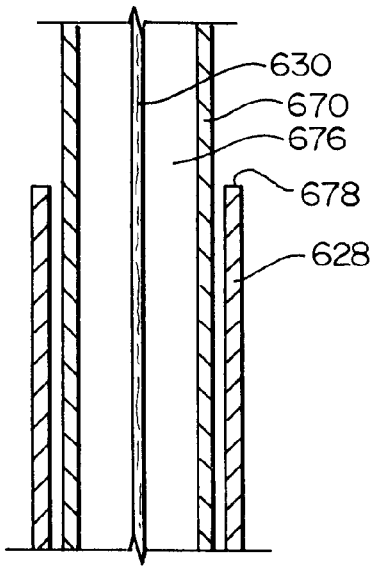
FIG. 12 is a section view of the upper end of a mandrel being driven by the system of FIG. 11 depicting an interaction between the mandrel and a wind sleeve that protects the wick material above the mandrel.

FIG. 12 shows that the wind tube 670 is hollow and defines a wind tube chamber 676 through which the wick drain material 630 passes. FIG. 12 also shows an upper end 678 of the mandrel 628.

Figure 13:
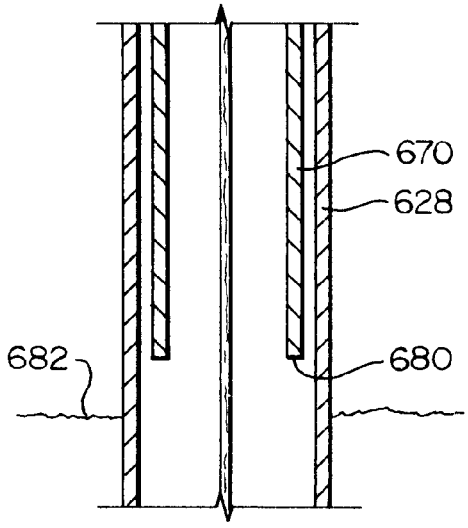
FIG. 13 is a section view of the lower end of the wind sleeve of the system of FIG. 11 depicting the interaction between the mandrel and the wind sleeve.

Referring to FIG. 13, depicted therein is a lower end 680 of the wind tube 670. This lower end 680 is at or near a surface 682; preferably, but not necessarily, when the mandrel 628 is fully driven into the earth, at least a portion of the wind tube 670 remains within the mandrel 628.

The embodiment described in FIGS. 11–13 does not require the insertion assembly 624 to support a mast above the location 642 at which the wick drain material 630 is to be inserted. This arrangement also allows the crane 622 to assist in pulling the mandrel 628 out of the ground by lifting the cables 638 and 640. Because the mandrel 628 is not enclosed within a mast or housing, the upper end 678 of the mandrel 628 is exposed and the operator of the system 620 knows how deep the mandrel 628 extends into the ground.

Figure 14:
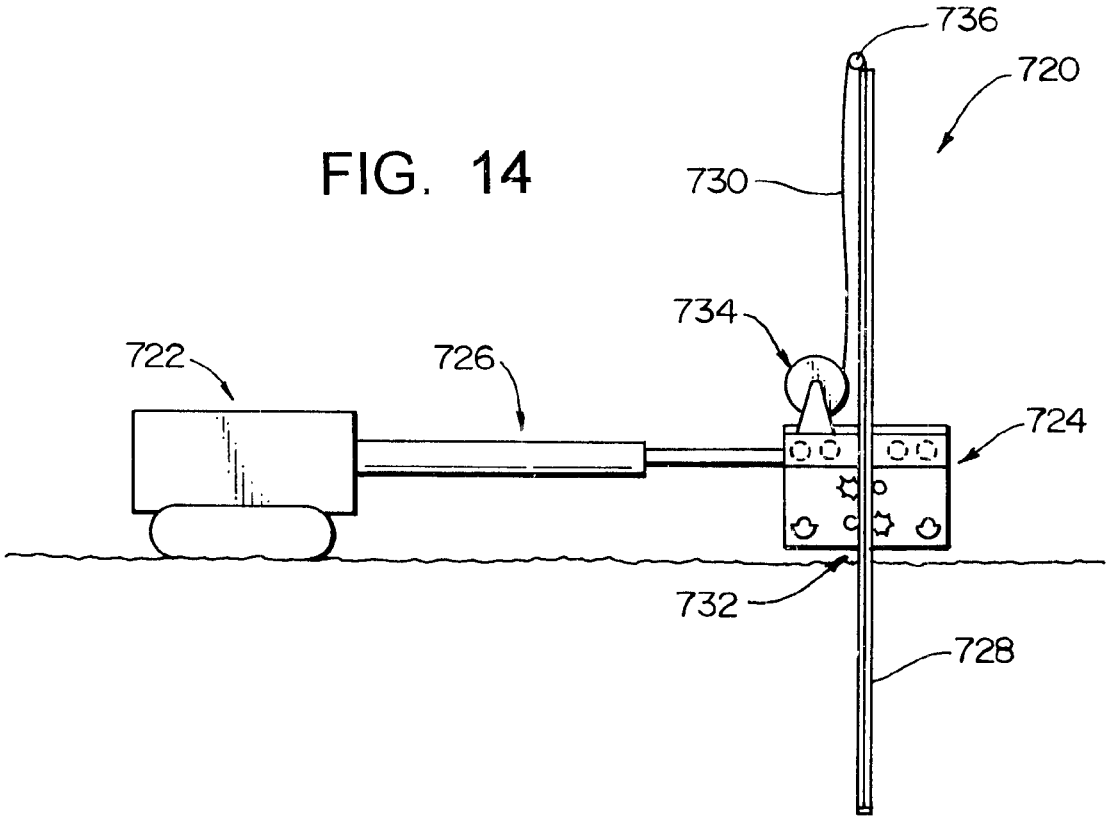
FIG. 14 is a somewhat schematic side elevation view of still another exemplary elongate member insertion/removal system that is constructed in accordance with the principles of the present invention.

Referring now to FIG. 14 depicted therein is yet another exemplary system 720 for inserting wick drain material into the ground. The system 720 comprises a movable truck 722, an insertion assembly 724, a spotter assembly 726, a mandrel 728, and wick drain material 730. The system 720 is similar to the system 620 described above but does not employ a crane with a boom to support the insertion assembly 724 above a desired location 732. Instead, the insertion assembly 724 is entirely supported by the spotter 726. In this case, a roll 734 of the wick drain material 730 is mounted on the insertion assembly 724 and is fed over a roller 736 on the mandrel 728 and then down through the mandrel 728. Expect for the fact that the roll 734 of wick drain material 730 is mounted on the insertion assembly 724, the insertion assembly 724 is constructed and operates in the same basic manner as the insertion assembly 624 described above.

The system 720 is highly appropriate for situations in which the wick drain material need not be inserted to a great depth. If the wick drain material is to inserted to a great depth, the system 620 described above is preferable.

In either case, the location at which the wick drain material is to be inserted need not be sufficiently stable to support the insertion assembly and mandrel. To the contrary, the crane 622 and/or truck 722 may be arranged some distance away from the location at which the wick drain is to be inserted.

6. Indicator System

Figure 15A:
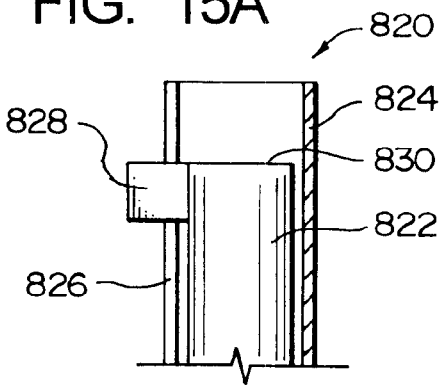
FIGS. 15A and 15B are side elevation views of an indicator system that may be used with any of the previous embodiments having a vertically extending mast that encloses the mandrel as the mandrel is driven into the ground.
Figure 15B:
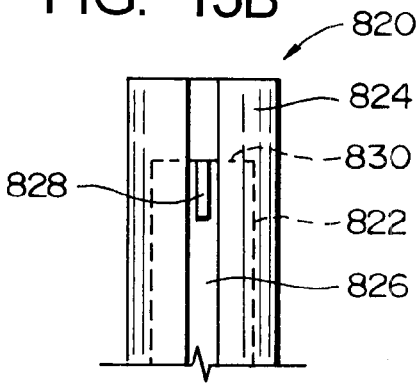

Referring to FIGS. 15A and 15B, depicted at 820 therein is an indicator system that may be used with any of the embodiments above having a vertically extending mast that encloses the mandrel as the mandrel is driven into the ground.

In particular, in FIGS. 15A and 15B, the mandrel is depicted at 822 and the mast is depicted at 824. A window 826 is formed along substantially the entire length of the mast 824, and an indicator 828 is formed on an upper end 830 of the mandrel 822. The exemplary window 826 is in the form of a continuous slot that extends substantially along the entire length of the mast 824. The indicator 828 is preferably painted a highly visible color.

As the mandrel 822 is driven into the earth, the upper end 830 thereof moves downward. If the mast is entirely closed, the mandrel upper end 830 is not visible and the operator does not know how far the mandrel 822 has been driven into the earth. With the exemplary system 820, the exemplary indicator 828 is a projection that extends out of the mast 824 through the window 826 and is thus clearly visible to the operator. The operator thus has a clear visual indication of how far the mandrel 822 has been driven into the earth.

The indicator 828 need not be a projection, however. The mandrel upper end 830 will be visible through the slot 826 without a projection or being painted and thus may serve the function of the indicator 828. Painting the mandrel upper end 830 a highly visible color will help the operator to see this upper end through the slot 826. And if the indicator 828 does not extend out of the mast 824, the window 826 need not be a continuous slot, but may instead be formed by a series of holes that allow the operator to view the mandrel upper end 830 and thus the indicator 828.

7. Sixth Embodiment

Figure 16:
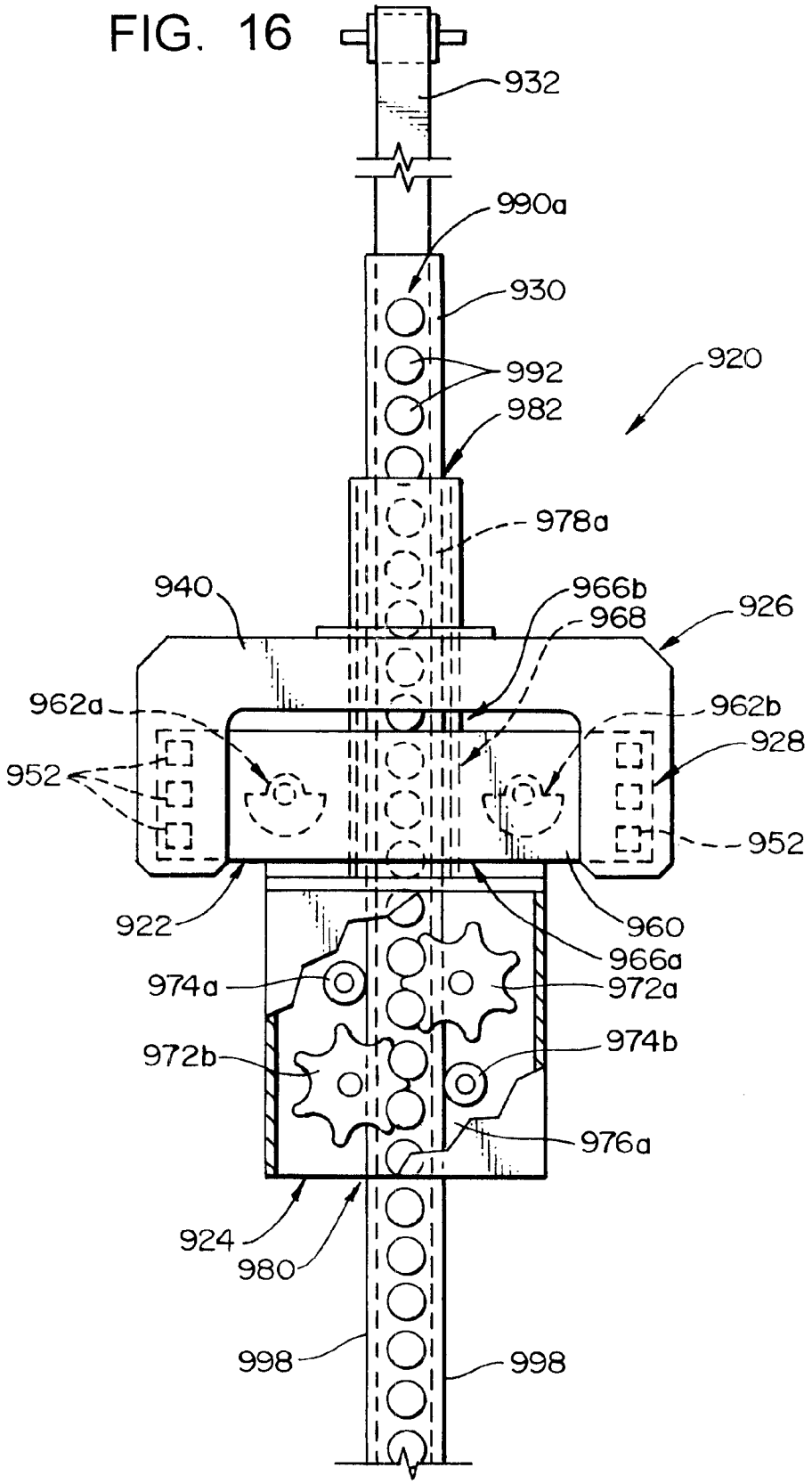
FIG. 16 is a front elevation view of a sixth embodiment of an elongate member insertion/removal system constructed in accordance with the principles of the present invention.
Figures 17, 17A:
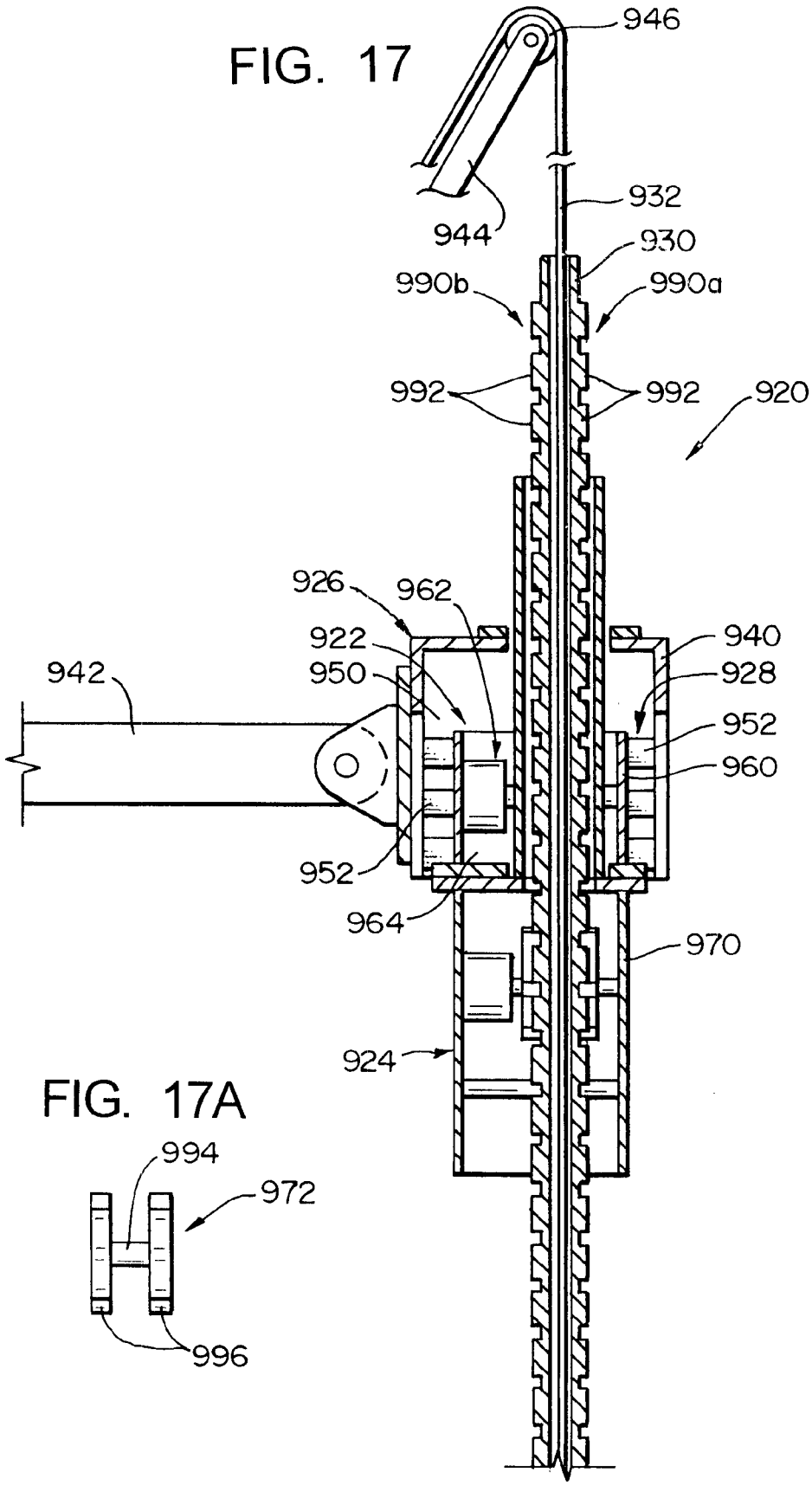
FIG. 17 is a partial cutaway side elevation view of the sixth embodiment of FIG. 16.
Figure 18:
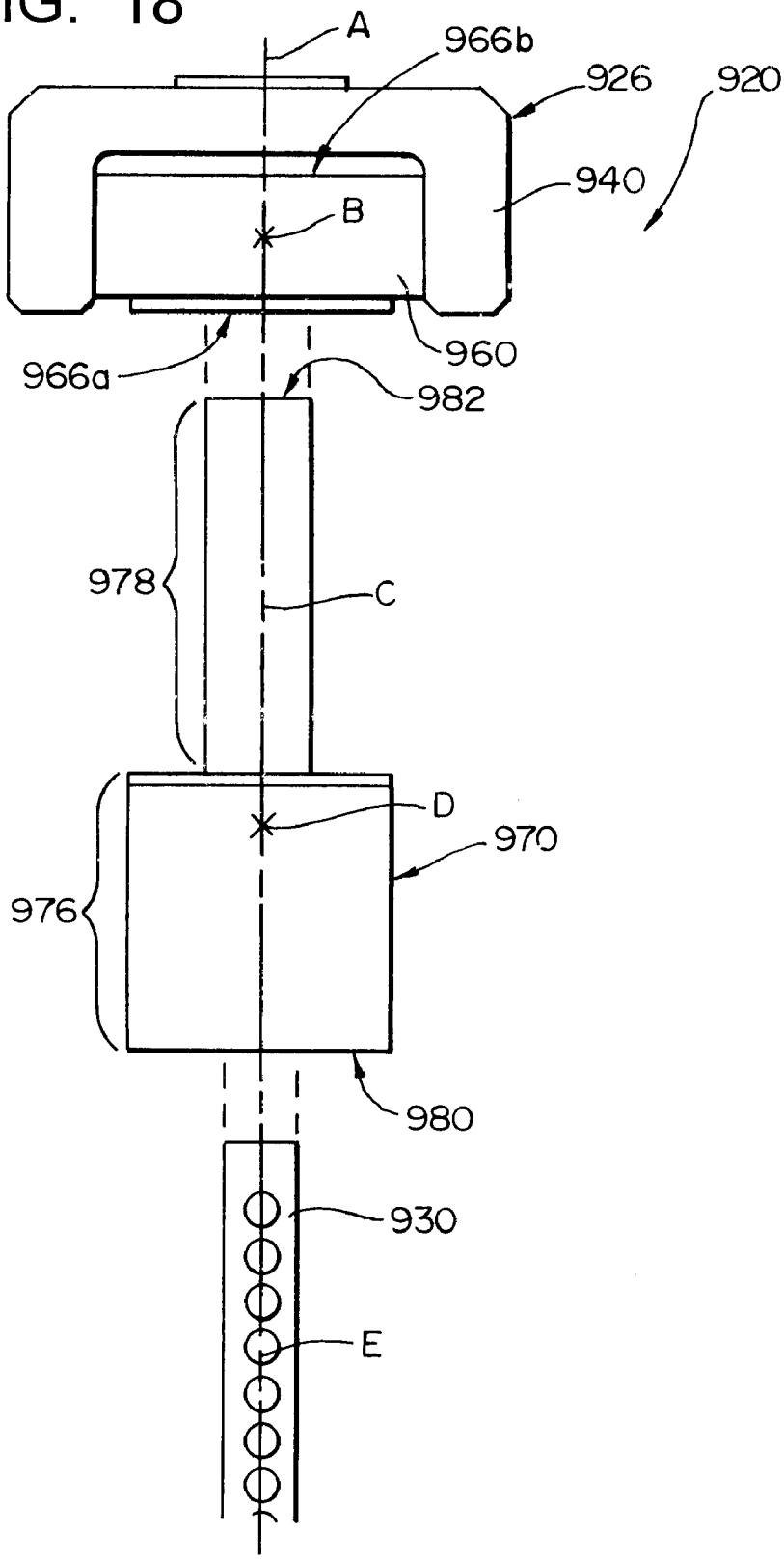
FIG. 18 is a somewhat schematic exploded view of the sixth embodiment of FIG. 16.

Referring now to FIGS. 16–18, depicted at 920 therein is a sixth embodiment of a system for inserting elongate members into and/or removing elongate members from the earth. The exemplary system 920 comprises a vibratory assembly 922, a drive assembly 924, a support assembly 926, and a shock absorbing system 928.

The support assembly 926 supports the elongate member at a desired location. The vibratory assembly 922 generates vibratory forces and is attached to the support assembly by the shock absorbing system 926 to reduce transmission of these vibratory forces to the support assembly 926. The drive assembly 924 generates a driving force and is attached to the vibratory assembly 922. The drive assembly 924 transmits vibratory and/or driving forces to the elongate member being driven.

More specifically, the elongate member being driven is a mandrel 930 capable of carrying wick drain material 932 into the ground. Other elongate members such as piles, wall anchors, and the like may be drive using the system 920, but the present invention is of particular significance when applied to elongate members, such as wick drain mandrels, that are repeatedly inserted and removed and not left in place.

The support assembly 926 comprises a support housing 940 that is supported at a desired location. The exemplary support housing 940 is attached to a spotter arm 942 extending from a vehicle (not shown), but other systems and methods of supporting the support housing 940 may be used. Because the system 920 is configured to drive the wick drain mandrel 930, the exemplary support system 940 comprises a roller arm 944 on which is mounted a roller bearing 946. The roller arm 944 and roller bearing 946 suspend the wick drain material 932 above the desired location for purposes that will become apparent from the following discussion.

The support housing 940 defines a support chamber 950 sized and dimensioned to accommodate at least a portion of the vibratory assembly 922. The support chamber 950 is also slightly oversized relative to the vibratory assembly 922 to allow movement of the assembly 922 within a limited range. And as shown in FIG. 17, the support chamber 950 is also large enough to accommodate one or more shock absorbing members 952 that form the shock absorbing system 928.

The shock absorbing members 952, which are or may be conventional, extend between the support housing 940 and the vibratory assembly 922. The shock absorbing members 952 resiliently oppose movement of the vibratory assembly 922 relative to the support housing 940 but allow the vibratory assembly 922 to move within the limited range defined by the support chamber 950. The shock absorbing members 952 thus limit the magnitude of the vibratory forces that are transmitted from the vibratory assembly 922 to the support housing 940.

Referring for a moment back to FIG. 16, the vibratory assembly 922 comprises a vibratory housing 960 and first and second eccentric assemblies 962*a* and 962*b*. The vibratory housing 960 defines a vibratory chamber 964 and a vibratory axis A. The vibratory assembly 922 is conventional in that the eccentric assemblies 962 are mounted within the vibratory chamber 964 and eccentric members thereof are counter-rotated such that lateral forces are cancelled and longitudinal forces are summed to create vibratory forces substantially along the vibratory axis A.

First and second sleeve openings 966*a* and 966*b* are formed in the vibratory housing 960. These openings 966 may also be referred to herein as lower and upper openings, respectively. The openings 966 further define a sleeve passageway 968. The sleeve passageway 968 is aligned with the vibratory axis A, and the vibratory axis A extends along through these openings 966. The purpose of the sleeve openings 966 and the sleeve passageway 968 will be discussed in further detail below.

The preferred assembly 922 is symmetrical such that a center of gravity B thereof is arranged substantially along the vibratory axis A. In particular, as best shown in FIG. 16, the eccentric assemblies 962 are spaced from each other such that the sleeve passageway 968 extends between the members 962. The vibratory forces generated by the vibratory assembly 922 are thus substantially symmetrically formed along the vibratory axis A and the sleeve passageway 968.

FIG. 16 also shows that the exemplary drive assembly 924 comprises a drive housing 970, first and second drive gears 972*a* and 972*b*, and first and second drive rollers 974*a* and 974*b*. The drive housing 970 comprises a main portion 976 defining a main chamber 976*a* and a sleeve portion 978 defining a sleeve chamber 978*a*. The drive housing 970 further comprises a first opening 980 formed in the main portion 976 and a second opening 982 formed in the sleeve portion 978.

The drive gears 972*a* and 972*b* and drive rollers 974*a* and 974*b* can be made of any relatively rigid material and by any conventional manufacturing technique. However, the Applicant has discovered that the drive gears 972 are preferably manufactured using a manganese alloy that hardens under impact. Accordingly, rather than wearing under impact when transferring vibratory forces to the mandrel 930, the impacts strengthen the drive gears 972, thereby increasing the useful life of the drive gears 972. The particular manganese alloy selected by the Applicant for use as the drive gears 972 is commonly referred to in the industry as Hadfield Manganese (ASTM A-128 Grade A manganese) or the equivalent thereof.

The drive assembly 924 defines a drive axis C and a center of gravity D. The drive housing 970, drive gears 972, and drive rollers 974 are all symmetrically arranged about the drive axis C such that the drive axis C substantially extends through the center of gravity D.

Referring now for a moment to the mandrel 930, as best shown in FIGS. 16 and 17, drive racks 990*a* and 990*b* are formed on opposing sides of the mandrel 930. The exemplary drive racks 990 take the form of drive pins or projections 992 that extend from the mandrel 930. The drive pins 992 are sized, dimensioned, and spaced from each other such that the drive gears 972 engage the drive pins 992 and, when rotated, cause the mandrel 930 to move along the drive axis C. The mandrel 930 defines a longitudinal axis E as shown in FIG. 18, and the mandrel 930 is displaced along this axis E when driven into or removed from the ground.

The exemplary first and second drive rollers 974*a* and 974*b* are arranged opposite the first and second drive gears 972*a* and 972*b*, respectively, to limit lateral movement of the mandrel 930 relative to the drive housing 970. In particular, the exemplary drive gears 972 comprise a central roller portion 994 and first and second gear portions 996. The roller portions 994 and drive rollers 974 engage opposing roller surfaces 998 on the mandrel 930. The roller portions 994 and drive rollers 974 thus limit lateral movement of the mandrel in a first plane relative to the drive housing 970. The gear portions 996 straddle the mandrel 930 such that one of the gear portions 996 of each of the drive gears 972 engage one of the drive racks 990. The gear portions 996 thus limit lateral movement of the mandrel in a second plane perpendicular to the first plane.

In the exemplary system 920, the drive housing 970 is bolted or otherwise detachably attached to the vibratory housing 960 such that vibratory forces created by the vibratory assembly 922 are transmitted to the drive gears 972 and drive rollers 974. Preferably, the vibratory axis A and drive axis C are substantially aligned when the drive housing 970 is attached to the vibratory housing 960. In addition, when the mandrel 930 is engaged by the drive gears 972, the longitudinal axis E of the mandrel 930 is substantially aligned with the drive axis C and thus the vibratory axis A.

As perhaps best shown in FIG. 16, in the exemplary system 920 the sleeve portion 978 extends through the first sleeve opening 966*a*, along the sleeve passageway 968, and through the second sleeve opening 966*b*. While a substantial portion of the sleeve portion 978 is within the vibratory chamber 964, a distal end 978*a* of the sleeve portion 978 is located outside of the vibratory chamber 964. Material cannot move from the sleeve chamber 978*a* into the vibratory chamber 964 without first exiting either of the first or second openings 980 or 982 in the drive housing 970 and then entering the vibratory chamber 964 through one of the sleeve openings 966. The sleeve portion 978 thus protects the contents of the vibratory housing 960, and in particular the eccentric assemblies 962, from dirt, water, and the like that adheres to the mandrel 930 as it is withdrawn from the ground.

Although a substantial benefit of the sleeve portion 978 can be obtained with the drive housing 970 bolted above the vibratory assembly 922, the drive housing 970 is preferably bolted to a bottom of the vibratory assembly 922 as shown in FIGS. 16–18. In this case, the drive gears 972 and drive rollers 974 engage, and dislodge dirt, debris, and the like from, the mandrel 930 below the vibratory assembly 922. The dirt and debris will thus fall away from the vibratory assembly 922. Accordingly, substantial benefits can be obtained by attaching the drive assembly 924 below the vibratory assembly 922, even if the sleeve portion 978 is not used.

Given the foregoing structure, both the driving forces generated by the drive assembly 924 and vibratory forces generated by the vibratory assembly 922 are transmitted to the mandrel 930 through the drive gears 972. Accordingly, a user of the system 920 may elect to use only driving forces, only vibratory forces, or the combination of driving forces and vibratory forces to drive the mandrel 930 into the earth. In addition, the location of the drive assembly 924 below the vibratory assembly 922 and/or the use of a sleeve portion 978 on the drive housing 970 will help to protect the vibratory assembly 922 from damage caused by dirt and debris. The exemplary system 920 thus drives the mandrel 930 into the ground; the mandrel 930 carries the wick drain material 932 into the earth. The roller bearing 946 feeds the wick drain material 932 into the upper end of the mandrel 930 in a conventional manner.

Another advantage of the present invention is that in the exemplary system 920, the function of the drive assembly 924 is separated from the function of the vibratory assembly 922. In particular, the drive assembly 924 may be detached from the vibratory assembly 922. The vibratory assembly 922 may then be attached to a clamp device that allows the vibratory assembly 922 to be connected to a different type of elongate member (perhaps a cylindrical pile or caisson) that does not have drive pins thereon for engagement with the drive gears 972. The vibratory assembly 922 is then operated in a conventional manner to drive the different type of elongate member.

The exemplary system 20 is thus more reliable and more flexible than other systems and methods for inserting elongate members into or withdrawing elongate members from the earth.

From the foregoing, it should be clear that the present invention may be embodied in forms other than those described above. The above-described systems are therefore to be considered in all respects illustrative and not restrictive, the scope of the invention being indicated by the appended claims rather than the foregoing description. All changes that come within the meaning and scope of the claims are intended to be embraced therein.

What is claimed is:

1. A system for displacing an elongate member relative to the ground, comprising:

a drive rack formed on at least one surface of the elongate member;

a support assembly capable of supporting the elongate member at a desired location;

a vibratory assembly comprising a vibratory housing defining a vibratory chamber and a vibratory axis, and a vibratory system mounted within the vibratory chamber to generate a vibratory force along the vibratory axis;

a drive assembly comprising a drive housing comprising a main portion defining a drive chamber and a sleeve portion defining a sleeve chamber, where a drive axis extends through the drive chamber and the sleeve chamber, and a drive system mounted within the drive chamber and comprising a drive gear that rotates to generate a drive force along the drive axis; and at least one shock absorbing member for mounting the vibratory housing onto the support assembly to reduce the transmission of vibratory forces from the vibratory housing to the support assembly; wherein the drive housing is attached to the vibratory assembly such that the drive axis, the vibratory axis, and a longitudinal axis of the elongate member are substantially aligned, and the sleeve portion extends through at least a substantial portion of the vibratory chamber; and the elongate member extends through the drive chamber and the sleeve chamber such that the drive gear engages the drive rack to transfer at least one of the vibratory force and the drive force to the elongate member and thereby displace the elongate member relative to the ground.

2. A system as recited in claim 1, in which:

the vibratory assembly defines a vibratory center of gravity; and the vibratory axis extends through the vibratory center of gravity.

3. A system as recited in claim 2, in which:

the drive assembly defines a drive center of gravity; and the drive axis extends through the drive center of gravity.

4. A system as recited in claim 1, in which:

the drive assembly defines a drive center of gravity; and the drive axis extends through the drive center of gravity.

5. A system as recited in claim 1, in which:

the sleeve portion defines a distal end; and the distal end of the sleeve portion extends into the vibratory chamber through a first drive opening and out of the vibratory chamber through a second drive opening.

6. A system as recited in claim 5, in which:

the distal end of the sleeve portion is spaced from the main portion of the drive housing; and the first drive opening is lower than the second drive opening.

7. A system as recited in claim 1, in which the sleeve portion extends into the vibratory chamber to substantially prevent movement of material between the sleeve chamber and the vibratory chamber.

8. A system as recited in claim 1, in which the drive housing is detachably attached to the vibratory assembly.

9. A system as recited in claim 1, in which:

first and second drive racks are formed on opposite sides of the elongate member; and the drive assembly comprises first and second gear members arranged on opposite sides of the drive axis such that, when the elongate member extends through the drive chamber, the first gear member engages the first drive rack and the second gear member engages the second drive rack.

10. A system as recited in claim 9, in which:

the drive assembly further comprises first and second roller members arranged on opposite sides of the drive axis;

the first roller member is arranged opposite the first gear member and the second roller member is arranged opposite the second gear member such that lateral movement of the elongate member relative to the drive housing is substantially prevented.

11. A system as recited in claim 1, in which the drive gears are made of manganese alloy.

12. A method of displacing an elongate member relative to the ground, comprising:

forming a drive rack on at least one surface of the elongate member;

supporting the elongate member at a desired location;

providing a vibratory housing defining a vibratory chamber and a vibratory axis;

mounting a vibratory system within the vibratory chamber to form a vibratory assembly that generates a vibratory force along the vibratory axis;

providing a drive housing comprising a main portion defining a drive chamber and a sleeve portion defining a sleeve chamber, where a drive axis extends through the drive chamber and the sleeve chamber;

providing a drive system comprising a drive gear;

mounting the drive system within the drive chamber to form a drive assembly, where rotation of the drive gear generates a drive force along the drive axis;

supporting the vibratory housing on the support assembly using at least one shock absorbing member that reduces the transmission of vibratory forces from the vibratory housing to the support assembly;

attaching the drive housing to the vibratory assembly such that the sleeve portion extends through at least a substantial portion of the vibratory chamber and the drive axis, the vibratory axis, and a longitudinal axis of the elongate member are substantially aligned;

extending the elongate member through the drive chamber and the sleeve chamber such that the drive gear engages the drive rack; and operating at least one of the vibratory system and the drive system to transfer at least one of the vibratory force and the drive force to the elongate member and thereby insert the elongate member into the ground.

13. A method as recited in claim 12, further comprising the step of arranging a vibratory center of gravity defined by the vibratory assembly and a drive center of gravity defined by the drive assembly substantially along the longitudinal axis of the elongate member.

14. A method as recited in claim 12, further comprising the steps of extending a distal end of the sleeve portion into the vibratory chamber through a first drive opening and out of the vibratory chamber through a second drive opening.

15. A method as recited in claim 14, further comprising the steps of:

spacing the distal end of the sleeve portion from the main portion of the drive housing; and arranging the vibratory housing such that the first drive opening is lower than the second drive opening.

16. A method as recited in claim 12, in which the step of providing the drive housing further comprises the step of configuring the sleeve portion such that, when the sleeve portion extends into the vibratory chamber, the sleeve portion substantially prevents movement of material between the sleeve chamber and the vibratory chamber.

17. A method as recited in claim 12, further comprising the steps of:

detaching the vibratory assembly from the drive assembly; and operating the vibratory assembly independently of the drive assembly.

18. A method as recited in claim 17, in which the step of providing the drive system comprises the step of providing first and second drive gears and first and second roller members, where the first roller member is arranged opposite the first gear member and the second roller member is arranged opposite the second gear member.

19. A system for displacing an elongate member relative to the ground, comprising:

first and second drive racks formed on opposing surfaces of the elongate member;

a support assembly for maintaining the elongate member in a desired orientation with respect to the ground;

a vibratory assembly comprising a vibratory housing defining a vibratory chamber and a vibratory axis, and first and second eccentric members mounted within the vibratory chamber such that rotation of the eccentric members generates a vibratory force along the vibratory axis;

a drive assembly comprising a drive housing comprising a main portion defining a drive chamber and a sleeve portion defining a sleeve chamber, where a drive axis extends through the drive chamber and the sleeve chamber, and a drive system mounted within the drive chamber and comprising first and second drive gears arranged on opposing sides of the drive axis, where rotation of the drive gears generates a drive force along the drive axis; and at least one shock absorbing member for mounting the vibratory housing onto the support assembly to reduce the transmission of vibratory forces from the vibratory housing to the support assembly; wherein the drive housing is attached to the vibratory assembly such that the drive axis, the vibratory axis, and a longitudinal axis of the elongate member are substantially aligned, and the sleeve portion extends through the vibratory chamber to substantially prevent movement of material between the sleeve chamber and the vibratory chamber; and the elongate member extends through the drive chamber and the sleeve chamber such that the first and second drive gears engage the first and second drive racks, respectively, to transfer at least one of the vibratory force and the drive force to the elongate member and thereby displace the elongate member relative to the ground.

20. A system as recited in claim 19, in which the drive housing is detachably attached to the vibratory assembly.

21. A system as recited in claim 19, in which:

the drive assembly further comprises first and second roller members arranged on opposite sides of the drive axis;

the first roller member is arranged opposite the first gear member and the second roller member is arranged opposite the second gear member such that lateral movement of the elongate member relative to the drive housing is substantially prevented.

22. A system as recited in claim 19, in which the drive gears are made of manganese alloy.

* * * * *